US008317962B2

(12) United States Patent
Hatano

(10) Patent No.: US 8,317,962 B2
(45) Date of Patent: Nov. 27, 2012

(54) BASE MATERIAL PROCESSING DEVICE AND BASE MATERIAL PROCESSING METHOD USING THE SAME

(75) Inventor: Akitsugu Hatano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 561 days.

(21) Appl. No.: 12/528,365

(22) PCT Filed: Jan. 23, 2008

(86) PCT No.: PCT/JP2008/050894
§ 371 (c)(1),
(2), (4) Date: Aug. 24, 2009

(87) PCT Pub. No.: WO2008/139750
PCT Pub. Date: Nov. 20, 2008

(65) Prior Publication Data

US 2010/0095816 A1 Apr. 22, 2010

(30) Foreign Application Priority Data

May 16, 2007 (JP) ..... 2007-130228

(51) Int. Cl.
*B32B 37/00* (2006.01)
*B32B 37/02* (2006.01)
*B32B 38/00* (2006.01)
*B32B 38/04* (2006.01)
*B32B 38/18* (2006.01)

(52) U.S. Cl. ..... 156/264; 156/157; 156/159; 156/250; 156/254; 156/256; 156/259; 156/270; 156/271

(58) Field of Classification Search ..... 156/156, 156/157, 159, 250, 254, 256, 259, 264, 269, 156/270, 271, 502, 504, 507; 242/551, 552, 242/553
See application file for complete search history.

(56) References Cited

U.S. PATENT DOCUMENTS

| | | | |
|---|---|---|---|
| 6,320,643 | B1 | 11/2001 | Morita |
| 2003/0136536 | A1 | 7/2003 | Viljanmaa |
| 2003/0209629 | A1 | 11/2003 | Hirata et al. |
| 2005/0098677 | A1 | 5/2005 | Hirata et al. |

FOREIGN PATENT DOCUMENTS

| | | | |
|---|---|---|---|
| EP | 1 364 897 | A1 | 11/2003 |
| JP | 2002-087665 | A | 3/2002 |
| JP | 2005-178291 | A | 7/2005 |
| JP | 2005-185884 | A | 7/2005 |
| JP | 2006-027814 | A | 2/2006 |
| WO | 01/63046 | A1 | 8/2001 |

OTHER PUBLICATIONS

Official Communication issued in International Patent Application No. PCT/JP2008/050894, mailed on Apr. 22, 2008.

*Primary Examiner* — Mark A Osele
*Assistant Examiner* — Christopher C Caillouet
(74) *Attorney, Agent, or Firm* — Keating & Bennett, LLP

(57) ABSTRACT

A base material processing device includes a first base material conveying section which receives from a first line and conveys a to-be-processed flexible base material, a base material dividing section which divides the flexible base material conveyed by the first base material conveying section, a route changing section which receives the flexible base material from its start edge formed by division by the base material dividing section and changes its conveyance route to a second line, and a second base material conveying section which is provided before the second line and holds and conveys to the second line a to-be-processed flexible base material.

10 Claims, 17 Drawing Sheets

BASE MATERIAL PROCESSING DEVICE AND BASE MATERIAL PROCESSING METHOD USING THE SAME

BACKGROUND OF THE INVENTION

1. Field of the Invention

The present invention relates to a base material processing device and a base material processing method using the device.

2. Description of the Related Art

In processes for manufacturing liquid crystal display devices, organic EL display devices, and the like, various process lines are provided, such as a base material exposure line, an exposed base material etching line, an etched base material cleaning line, and the like.

Recently, research has been actively made for liquid crystal display devices and organic EL display devices using flexible substrates having high flexibility and high impact resistance, such as plastic substrates and metal film substrates, in place of hard substrates, such as glass substrates, silicon wafer substrates, and the like. The flexible substrates having high flexibility cannot hold their shapes by themselves. For this reason, processes for manufacturing display devices using such flexible substrates excellent in flexibility use a roll-to-roll system for conveying a band-shaped base material with tension applied thereto. In the roll-to-roll system, the base material is conveyed in a roll to roll format (for example, Japanese Unexamined Patent Application Publication No. 2005-185884 or Japanese Unexamined Patent Application Publication No. 2002-087665).

In order to increase manufacturing efficiency, in some cases, the process lines may be operated for simultaneously conveying a flexible base material by using the roll-to-roll system.

However, in the case where a flexible base material, such as a plastic base material, or the like is conveyed in a roll-to-roll format through a single line that connects process lines, when malfunction occurs in some processing apparatus, not only the processing apparatus but also all of the other processing apparatuses must be stopped. This may decrease the manufacturing efficiency.

Further, the single route that connects the process lines cannot sufficiently address the case where a process line should be increased for urgent necessity for a production increase or the like.

Moreover, in the case where the route that connects process lines is not continued, and a continuous flexible base material must be moved to the next process line after a process in some process line is finished, the flexible base material is rolled up to a roll-shaped winder or the like every time a process is performed in each process line, and is then rolled out therefrom and conveyed to the next process line. In this processing method, the flexible base material rolled out from the roll-shaped winder or the like is subjected to the next process in such a manner that its portion on which the previous process is performed last is rolled out and processed first. For this reason, a difference in process waiting time (retention time) is generated within the continuous flexible base material. Particularly, the longer the flexible base material is, the greater this difference becomes, which serves as a factor of failure in base material processing.

SUMMARY OF THE INVENTION

In view of the foregoing, preferred embodiments of the present invention provide a device and method that allow for the processing of a continuous flexible base material in a plurality of manufacturing lines connected to each other to continue without stopping all the lines even upon occurrence of a problem, thereby providing a base material processing device and method that are excellent in processing efficiency.

A base material processing device according to a preferred embodiment of the present invention is a base material processing device, which is provided between a first line and a second line whose numbers of lines are different from each other, for line connection through processing conveyed continuous flexible base materials. The device includes: a first base material conveying section configured to receive from the first line and convey a to-be-processed flexible base material; a base material dividing section configured to divide the flexible base material from the first line conveyed by the first base material conveying section; a route changing section configured to receive the flexible base material from its base material start edge formed by division by the base material dividing section, and configured to change to the second line a conveyance route on which the received flexible base material is conveyed; and a second base material conveying section located before the second line, and configured to hold the to-be-processed flexible base material and to convey the held flexible base material to the second line.

In the above configuration, the base material processing device performing line connection between the first line and the second line includes the route changing section for changing the conveyance route of the flexible base material. Accordingly, when a problem or the like occurs in the first line or the second line, the conveyance route can be changed to a separately prepared substitute line. This may eliminate the need to stop all the lines upon occurrence of a problem or the like in some line. Further, when an urgent production increase is necessitated, for example, the number of lines included in the first line or the second line which has a slower processing speed is increased, and the conveyance route is changed to any of the increased lines to increase processing efficiency of the flexible base material. Thus, the urgent production increase can be addressed. In addition, since the route connecting the process lines is continuous, it is unnecessary to wind up the flexible base material by a roll-shaped winder or the like every time a process is performed in each process line, and to roll out therefrom and convey the base material to the next process line. Hence, no difference in processing waiting time (retention time) may be generated within the continuous flexible base material, thereby preventing occurrence of base material processing failure.

According to a preferred embodiment of the present invention, in processing a continuous flexible base material in a plurality of manufacturing lines connected to each other, the base material processing is continued without stopping all the lines even upon occurrence of a problem, thereby providing a base material processing device that is excellent in processing efficiency and a base material processing method using the device.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

A base material processing device and base material processing methods using the base material processing device according to example preferred embodiments of the present invention will be described below in detail with reference to the drawings by referring to the case where a display device is manufactured thereby using a continuous and flexible plastic base material as a base material. The present invention is not limited to the following example preferred embodiments.

Example Preferred Embodiment 1

Configuration of Base Material Processing Device 10

Figure 1:
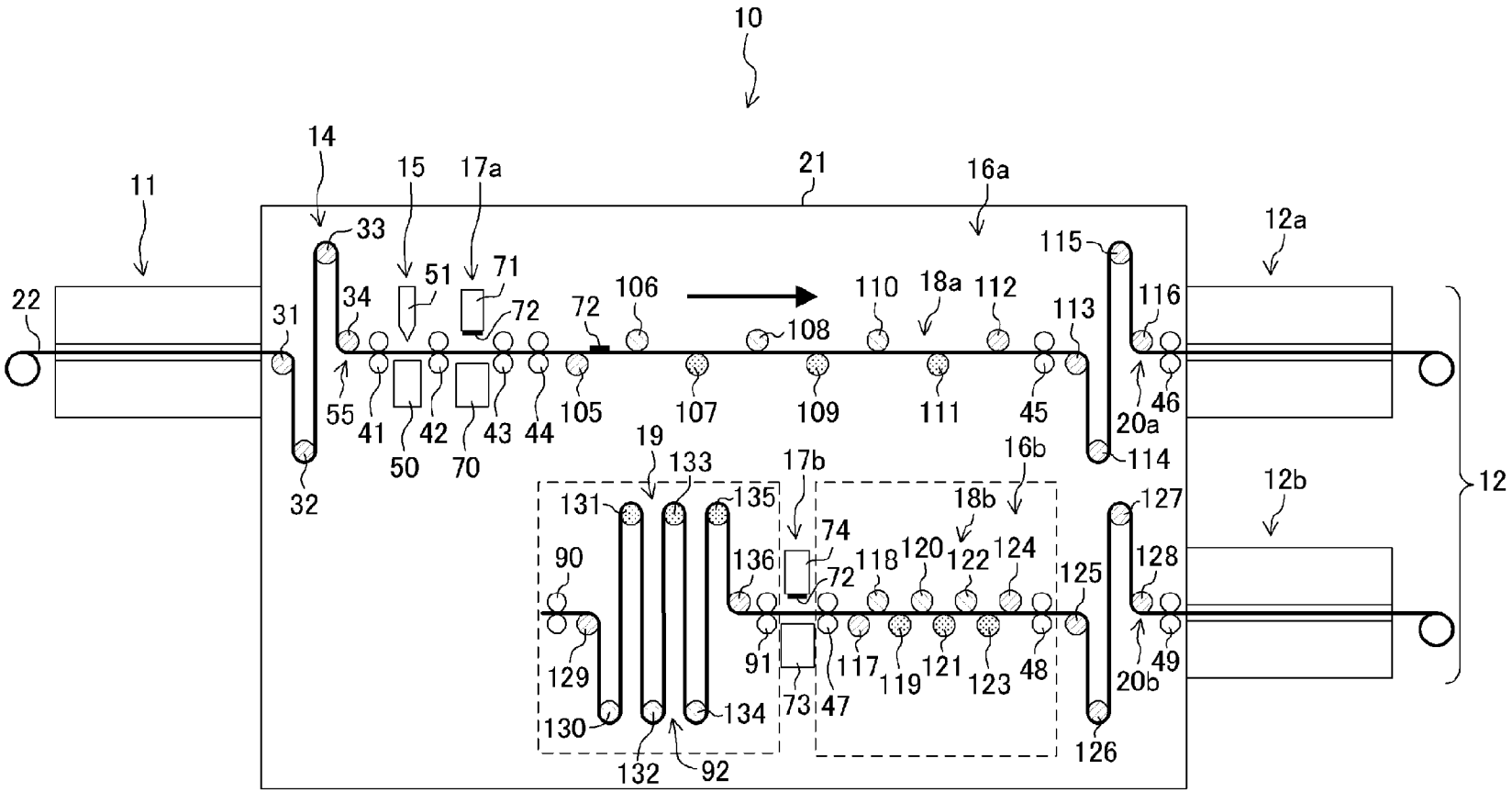
FIG. 1 is a schematic illustration of a base material processing device in which a first line is connected to a second A line, and a plastic base material held by a route changing section is sent to a second B line.
Figure 2:
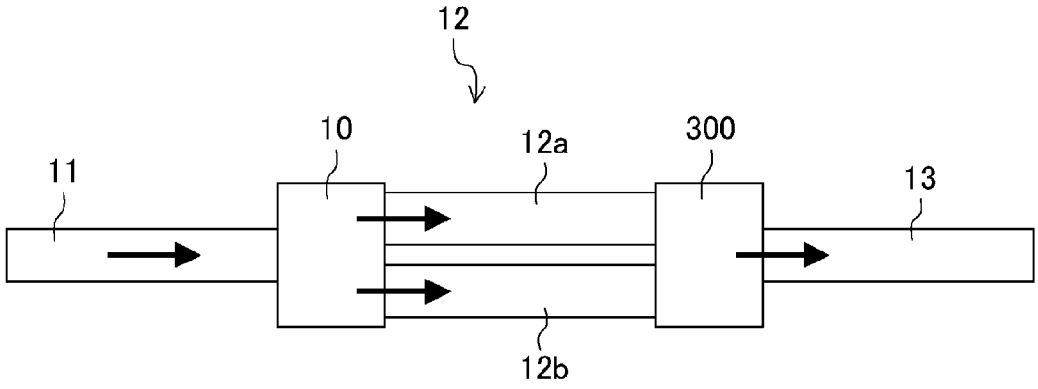
FIG. 2 is an illustration showing a positional relationship between the base material processing device and process lines.

FIG. 1 is a schematic illustration showing a base material processing device 10 according to Example Preferred Embodiment 1 of the present invention. As shown in FIG. 2, the base material processing device 10 is provided between adjacent two process lines (a first line 11 and a second line 12) among a plurality of process lines. The second line 12 includes a second A line 12*a* and a second B line 12*b* which perform the same process and are arranged in parallel to each other.

The base material processing device 10 includes a first base material conveying section 14 including a first base material supply adjusting section 55, a base material dividing section 15, a first base material joining section 17*a*, a second A line base material conveying section 16*a* including a second A line base material supply adjusting section 18*a* and a third A line base material supply adjusting section 20*a*, a second base material joining section 17*b*, a second B line base material conveying section 16*b* including a second B line base material supply adjusting section 18*b* and a third B line base material supply adjusting section 20*b*, a route changing section 19, a chamber 21, a control section now shown, and the like.

The first base material conveying section 14 is located at a position where a plastic base material 22 from the first line 11 is received first. The first base material conveying section 14 includes a first base material supply adjusting section 55, and first to third hold and conveyance roll pairs 41, 42, 43 paired so as to sandwich the plastic base material 22 on its opposite sides.

The first base material supply adjusting section 55 includes a first conveyance roll 31 receiving the plastic base material 22 conveyed from the first line 11, and second, third, and fourth conveyance rolls 32, 33, 34 sequentially conveying the plastic base material 22 sent from the first conveyance roll 31. The first conveyance roll 31 receiving the plastic base material 22 and the fourth conveyance roll 34 sending out the plastic base material 22 are fixed. The second and third conveyance rolls 32, 33 are configured to move to and away from each other so as to reciprocate simultaneously by the same distance in the direction intersected with a conveyance direction in which the plastic base material 22 is conveyed. The second and third conveyance rolls 32, 33 may be configured to reciprocate asymmetrically. The first to fourth conveyance rolls 31, 32, 33, 34 conveys the plastic base material 22 by rotating while coming in contact with the surfaces of the plastic base material 22. The first base material supply adjusting section 55 receives, holds, and then sends out the base material, or sends while receiving the base material.

The first to third hold and conveyance roll pairs 41, 42, 43 convey the plastic base material 22 by rotating while coming in contact with the surfaces of the plastic base material 22.

The base material dividing section 15 is located after the first hold and conveyance roll pair 41. The base material dividing section 15 has a function of aligning the conveyed plastic base material 22. The base material dividing section 15 includes a dividing stage 50, a cutter 51 or the like disposed above the dividing stage 50. In place of the cutter 51, a laser light irradiating section, a high pressure water releasing section releasing high pressure water, or the like may be provided above the dividing stage 50.

The first base material joining section 17*a* is located after the second hold and conveyance roll pair 42. The first base material joining section 17*a* has a function of aligning the conveyed plastic base material 22. The first base material joining section 17*a* includes a joining stage 70 and a joint tape attaching section 71 disposed above the joining stage 70. The joint tape attaching section 71 is provided with a chemical-resistant or heat-resistant joint tape 72. In place of the joint tape attaching section 71, a fusing section for fusing the plastic base material 22 may be provided. The joint tape 72 may be attached to the reverse surface or both the surfaces of the plastic base material 22. Examples of adhesive material of the joint tape 72 include a material whose adhesiveness is reduced by an ultraviolet light or heat, besides general adhesive materials. In this case, the base material dividing section may be a combination of an ultraviolet ray irradiating section and a tape recovery mechanism, or a combination of a tape heating section and a tape recovery mechanism. With these configurations, the mechanism can be simplified and downsized when compared with cutting by the cutter or the like, thereby facilitating installation.

The second A line base material conveying section 16*a* includes a second A line base material supply adjusting section 18*a*, a third A line base material supply adjusting section 20*a*, and fourth to sixth hold and conveyance roll pairs 44, 45, 46.

The second A line base material supply adjusting section 18*a* is located between the fourth hold and conveyance roll pair 44 and the fifth hold and conveyance roll pair 45. The second A line base material supply adjusting section 18*a* includes fifth to twelfth conveyance rolls 105 to 112. The fifth conveyance roll 105 receiving the plastic base material 22 and the twelfth conveyance roll 112 sending out the plastic base material 22 are configured to reciprocate in the conveyance direction of the plastic base material 22. They may be configured to reciprocate asymmetrically. The sixth to eleventh conveyance rolls 106 to 111 are configured to move to and away from one another so as to reciprocate simultaneously by the same distance in the direction intersected with the conveyance direction of the plastic base material 22. The sixth to eleventh conveyance rolls 106 to 111 may by configured to reciprocate asymmetrically. The sixth to eleventh conveyance rolls 106 to 111 are configured to reciprocate also in the conveyance direction of the plastic base material 22. The fifth to twelfth conveyance rolls 105 to 112 convey the plastic base material 22 by rotating while coming into contact with the surfaces of the plastic base material 22.

The fifth and sixth hold and conveyance roll pairs 45, 46 are fixed. The fourth hold and conveyance roll pair 44 is configured to reciprocate in the conveyance direction of the plastic base material 22.

The third A line base material supply adjusting section 20*a* is located after the second A line base material supply adjusting section 18*a* and before the second A line 12*a* between the fifth hold and conveyance roll pair 45 and the sixth hold and conveyance roll pair 46. The third A line base material supply adjusting section 20*a* includes a thirteenth conveyance roll 113 receiving the plastic base material 22 conveyed from the second A line base material supply adjusting section 18*a*, and fourteenth, fifteenth, and sixteenth conveyance rolls 114, 115, 116 sequentially conveying the received plastic base material 22. The thirteenth conveyance roll 113 receiving the plastic base material 22 and the sixteenth conveyance roll sending out the plastic base material 22 are fixed. The fourteenth and fifteenth conveyance rolls 114, 115 are configured to move to and away from each other so as to reciprocate simultaneously by the same distance in the direction intersected with the conveyance direction of the plastic base material 22. They may be configured to reciprocate asymmetrically. The thirteenth to sixteenth conveyance rolls 113 to 116 convey the plastic base material 22 by rotating while coming into contact with the surfaces of the plastic base material 22. With the above elements, the third A line base material supply adjusting section 20*a* receives, holds, and then sends the base material, or sends while receiving the base material.

The second base material joining section 17*b* and the second B line base material conveying section 16*b* including a second B line base material supply adjusting section 18*b* and a third B line base material supply adjusting section 20*b* are located in this order before the second B line 12*b*.

The second base material joining section 17*b* includes a joining stage 73 and a joint tape attaching section 74 disposed above the joining stage 73. The second base material joining section 17*b* has a function of aligning the conveyed plastic base material 22. The joint tape attaching section 74 of the second base material joining section 17*b* is provided with a chemical-resistant or heat-resistant joint tape 72. In place of the joint tape attaching section 74, a fusing section for fusing the plastic base material 22 may be provided. The joint tape 72 may be attached to the reverse surface or both the surfaces of the plastic base material 22.

The second B line base material conveying section 16*b* includes a second B line base material supply adjusting section 18*b*, a third B line base material supply adjusting section 20*b*, and seventh to ninth hold and conveyance roll pairs 47, 48, 49.

The second B line base material supply adjusting section 18*b* is located between the seventh hold and conveyance roll pair 47 and the ninth hold and conveyance roll pair 49. The second B line base material supply adjusting section 18*b* includes seventeenth to twenty-fourth conveyance rolls 117 to 124. The seventeenth conveyance roll 117 receiving the plastic base material 22 and the twenty-fourth conveyance roll 124 sending out the plastic base material 22 are fixed. The eighteenth to twenty-third conveyance rolls 118 to 123 are configured to move to and away from one another so as to reciprocate simultaneously by the same distance in the direction intersected with the conveyance direction of the plastic base material 22. They may be configured to reciprocate asymmetrically. The seventeenth to twenty-fourth conveyance rolls 117 to 124 convey the plastic base material 22 by rotating while coming in contact with the surfaces of the plastic base material 22.

The seventh to ninth hold and conveyance roll pairs 47, 48, 49 are fixed.

The third B line base material supply adjusting section 20*b* is located after the second B line base material supply adjusting section 18*b* and before the second B line 12*b* between the eighth hold and conveyance roll pair 48 and the ninth hold and conveyance roll pair 49. The third B line base material supply adjusting section 20*b* includes a twenty-fifth conveyance roll 125 receiving the plastic base material 22 conveyed from the second B line base material supply adjusting section 18*b*, twenty-sixth, twenty-seventh and twenty-eighth conveyance rolls 126, 127, 128 sequentially receiving the received plastic base material 22. The twenty-fifth conveyance roll 125 receiving the plastic base material 22 and the twenty-eighth conveyance roll 128 sending out the plastic base material 22 are fixed. The twenty-sixth and twenty-seventh conveyance rolls 126, 127 are configured to move to and away from each other so as to reciprocate simultaneously by the same distance in the direction intersected with the conveyance direction of the plastic base material 22. They may be configured to reciprocate asymmetrically. The twenty-fifth to twenty-eighth conveyance rolls 125 to 128 convey the plastic base material 22 by rotating while coming in contact with the surfaces of the plastic base material 22. With the above elements, the third B line base material supply adjusting section 20*b* receives, holds, and then sends out the base material, or sends out while receiving the base material.

The route changing section 19 includes a tenth hold and conveyance roll pair 90, an eleventh hold and conveyance roll pair 91, and a fourth base material supply adjusting section 92 disposed therebetween.

The tenth hold and conveyance roll pair 90 and the eleventh hold and conveyance roll pair 91 are fixed at the respective ends of a conveyance route in the route changing section 19.

The fourth base material supply adjusting section 92 includes a twenty-ninth conveyance roll 129 receiving the plastic base material 22 conveyed from the first base material conveying section 14, and thirtieth to thirty-sixth conveyance rolls 130 to 136 sequentially receiving the received plastic base material 22. The twenty-ninth conveyance roll 129 receiving the plastic base material 22 and the thirty-sixth conveyance roll 136 sending out the plastic base material 22 are fixed at the conveyance route in the route changing section 19. The thirtieth to thirty-fifth conveyance rolls 130 to 135 are configured to move to and away from one another so as to reciprocate simultaneously by the same distance in the direction intersected with the conveyance direction of the plastic base material 22 in the route changing section 19. They may be configured to reciprocate asymmetrically. The thirtieth to thirty-sixth conveyance rolls 130 to 136 convey the plastic base material 22 by rotating while coming in contact with the surfaces of the plastic base material 22. With the above elements, the route changing section 19 receives, holds, and then sends out the base material, or sends out while receiving the base material. The route changing section 19 is configured to reciprocate between a position between the first base material joining section 17*a* and the second A line base material conveying section 16*a* on the conveyance route connecting the first line 11 to the second A line 12*a* and a position before the second base material joining section 17*b* on the conveyance route connected to the second B line 112*b*.

The chamber 21 houses all of the first base material conveying section 14, the base material dividing section 15, the first base material joining section 17*a*, the second A line base material conveying section 16*a*, the second base material joining section 17*b*, the second B line base material conveying section 16*b*, and the route changing section 19. The inside of the chamber 21 is set almost at atmospheric pressure. The chamber 21 may be hermetic and have a purging function or a sucking function according to a desired process condition.

The first to ninth hold and conveyance roll pairs 41 to 49 may not sandwich the plastic base material 22 on its opposite sides, and may be a plurality of conveyance rolls provided only on one side of the conveyance route so as to come in contact with only the surface on the non-processed side of the base material. Alternatively, in the case where the plastic base material 22 is sandwiched on its respective sides, the first to ninth hold and conveyance roll pairs 41 to 49 may have a configuration in which the surface on the to-be-processed side of the plastic base material is caught at only its respective side end parts, or a configuration of a non-contact conveyance rolls blowing air to the surface on the to-be-processed side of the base material.

In addition, if a plastic base material conveyed is rigid enough, the plastic base material can be conveyed to the next process even with no base material joining section provided. Therefore, the base material joining section may be omitted. In this case, an arrangement in which the distances among the conveyance roll pairs are reduced can cause conveyance failure less often, which is further preferable.

Display Device Manufacturing Method Using the Base Material Processing Device 10

A display device manufacturing method using the base material processing device 10 according to Example Preferred Embodiment 1 of the present invention will be described next in detail.

As shown in FIG. 1, a continuous plastic base material 22 (a flexible base material), on one of the surfaces of which a film is formed, is conveyed from a first line 11 to a second line 12. The base material processing device 10 is provided between the first line 11 and the second line 12. The present example preferred embodiments refers to the case where the conveyance speed in the first line 11 is twice the conveyance speed in the second line 12, and the second line 12 includes a second A line 12*a* and a second B line 12*b* arranged in parallel to each other. The first line 11, the second A line 12*a*, and the second B line 12*b* convey the plastic base material 22 continuously without a stop.

First, as shown in FIG. 1, a to-be-processed continuous plastic base material 22, for example, preferably having a thickness of about 200 μm and a width of about 105 mm and made of polyimide is conveyed from the first line 11 into the base material processing device 10, and conveyed to the second A line 12*a* through the first base material conveying section 14 including the first base material supply adjusting section 55, and the second A line base material conveying section 16*a* including the second A line base material supply adjusting section 18*a* and the third A line base material supply adjusting section 20*a*. The second and third conveyance rolls 32, 33 of the first base material supply adjusting section 55 move away from each other in the direction intersected with the conveyance direction of the plastic base material 22 (the vertical direction in FIG. 1) to hold the plastic base material 22. The fifth to twelfth conveyance rolls 105 to 112 of the second A line base material supply adjusting section 18*a* move away from one another in the conveyance direction of the plastic base material 22 to convey the plastic base material 22 horizontally. The fourteenth and fifteenth conveyance rolls 114, 115 of the third A line base material supply adjusting section 20*a* move away from each other in the direction intersected with the conveyance direction of the plastic base material 22 (the vertical direction in FIG. 1) to hold the plastic base material 22.

The seventeenth to twenty-fourth conveyance rolls 117 to 124 of the second B line base material supply adjusting section 18*b* are arranged in two rows so as to sandwich for horizontally conveying a plastic base material 22 that is to be conveyed to the second B line 12*b*. The twenty-sixth and twentieth-seventh conveyance rolls 126, 127 of the third B line base material supply adjusting section 20*b* move away from each other in the direction intersected with the conveyance direction of the plastic base material 22 (the vertical direction in FIG. 1) to hold the plastic base material 22.

The route changing section 19 is located before the second B line base material conveying section 16*b*. The thirtieth to thirty-fifth conveyance rolls 130 to 135 of the fourth base material supply adjusting section 92 move away from one another in the direction intersected with the conveyance direction of the plastic base material 22 (the vertical direction in FIG. 1) to hold the plastic base material 22.

Figure 3:
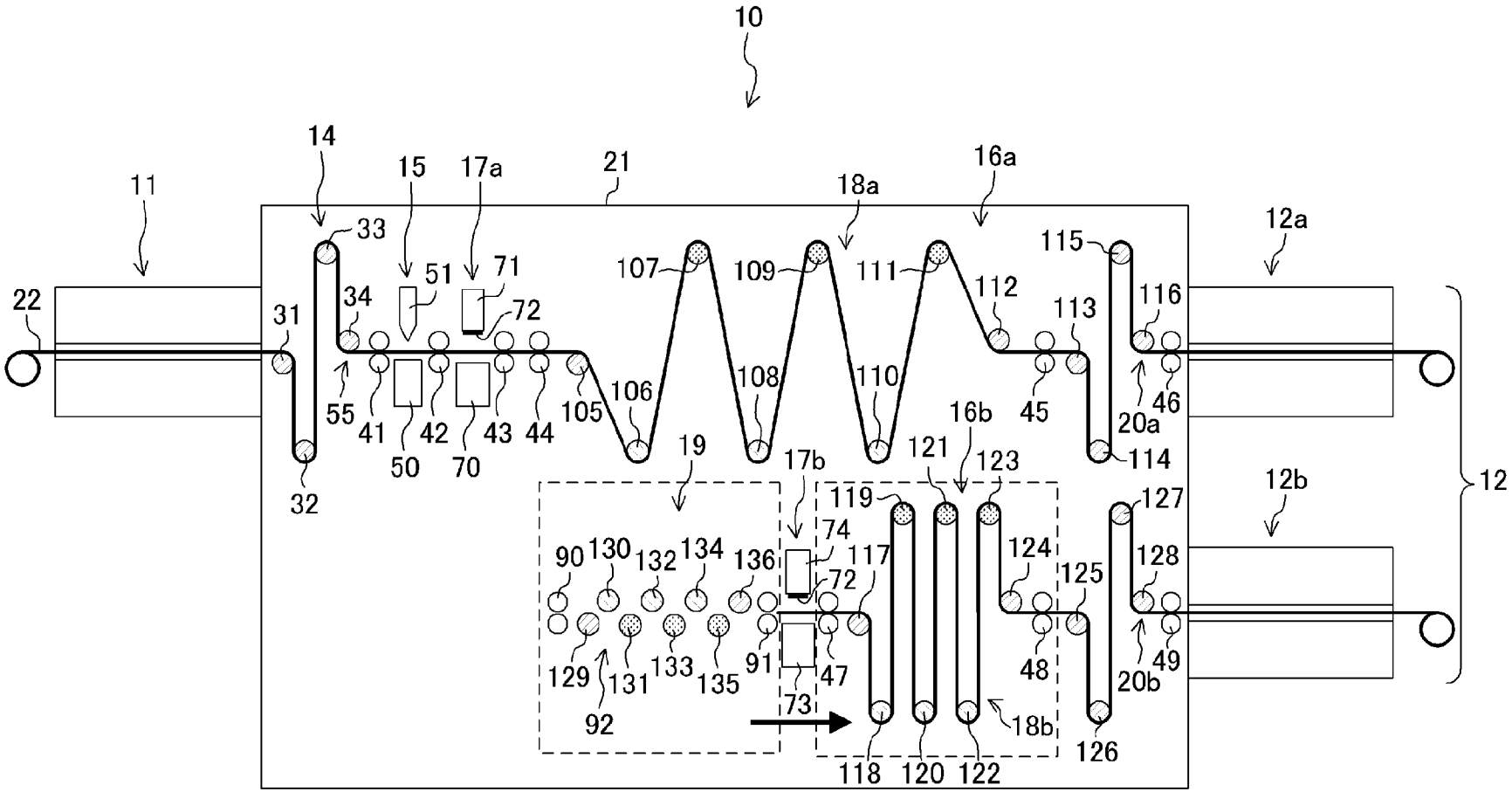
FIG. 3 is a schematic illustration of the base material processing device in which the first line is connected to the second A line, and the plastic base material held by the route changing section is sent out thoroughly.

Next, as shown in FIG. 3, the fifth to twelfth conveyance rolls 105 to 112 of the second A line base material supply adjusting section 18*a* move away from one another in the direction intersected with the conveyance direction of the plastic base material 22 to hold the plastic base material 22. In this way, the conveyance speed of the plastic base material 22 is adjusted between the first line 11 and the second A line 12*a* in which the conveyance speed is one half of the conveyance speed in the first line 11.

During this time, the thirtieth to thirty-fifth conveyance rolls 130 to 135 of the fourth base material supply adjusting section 92 in the route changing section 19 approach one anther in the direction intersected with the conveyance direction of the plastic base material 22 to send out the held plastic base material 22 to the second B line base material conveying section 16*b*. In the second B line base material conveying section 16*b* into which the plastic base material 22 is conveyed from the route changing section 19, the seventeenth to twenty-fourth conveyance rolls 117 to 124 of the second B line base material supply adjusting section 18*b* move away from one another in the direction intersected with the conveyance direction of the plastic base material 22 to hold the plastic base material 22.

Figure 4:
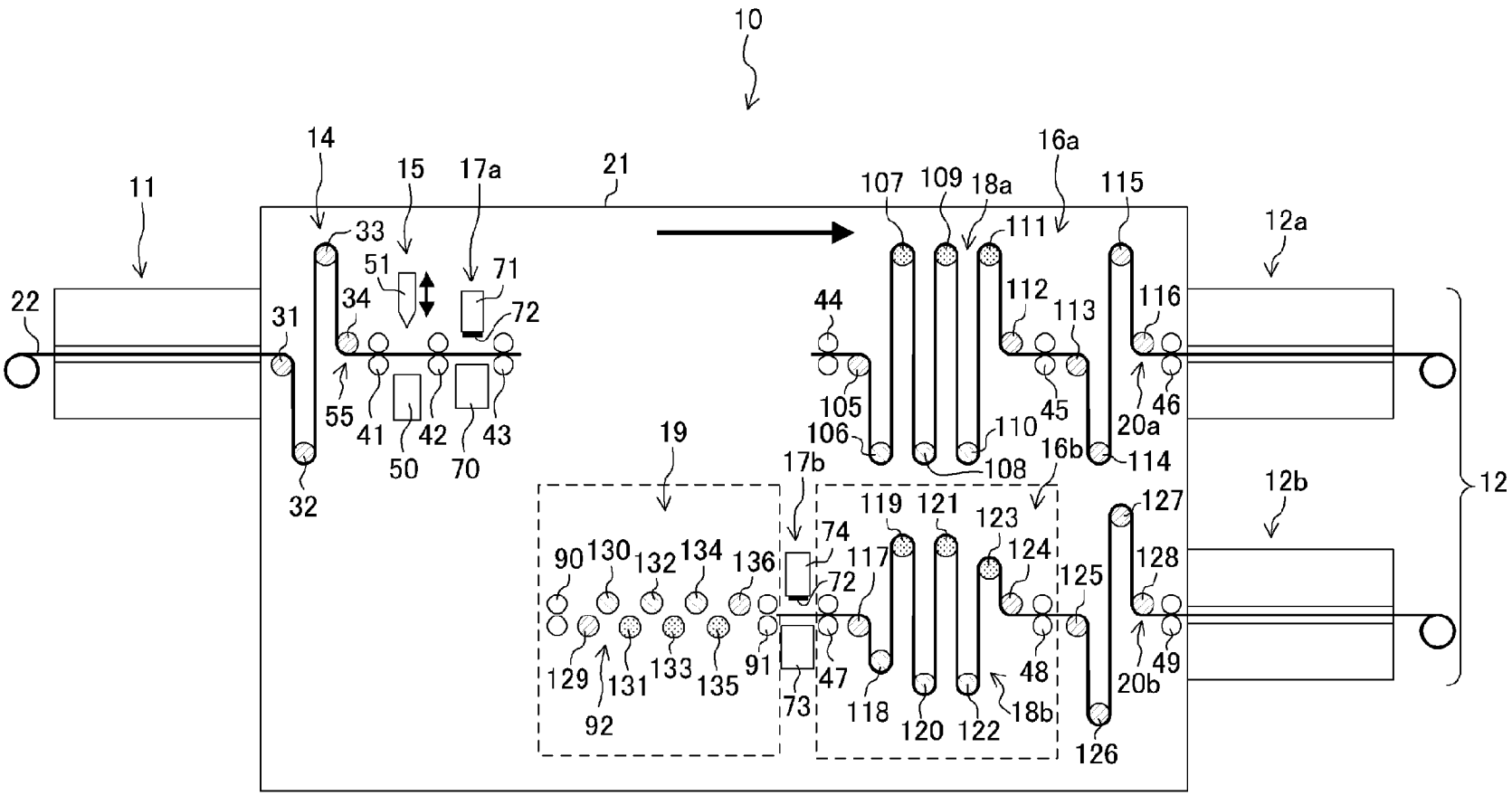
FIG. 4 is a schematic illustration of the base material processing device in which a second A line base material supply adjusting section contracts after the plastic base material is divided.

Next, as shown in FIG. 4, the base material dividing section 15 divides the plastic base material 22 at its predetermined point.

Subsequently, the fifth to twelfth conveyance rolls 105 to 112 of the second A line base material supply adjusting section 18*a* move in the conveyance direction of the plastic base material 22 to approach the third A line base material supply adjusting section 20*a*, thereby reducing the distances thereamong.

At the same time when the distances among the fifth to twelfth conveyance rolls 105 to 112 are reduced, the route changing section 19 moves to the space between the first base material joining section 17*a* and the contracting second A line base material supply adjusting section 18*a*. Further, the seventeenth to twenty-fourth conveyance rolls 117 to 124 of the second B line base material supply adjusting section 18*b* move in the direction intersected with the conveyance direction of the plastic base material 22 to approach one another, thereby sending the plastic base material 22.

Figure 5:
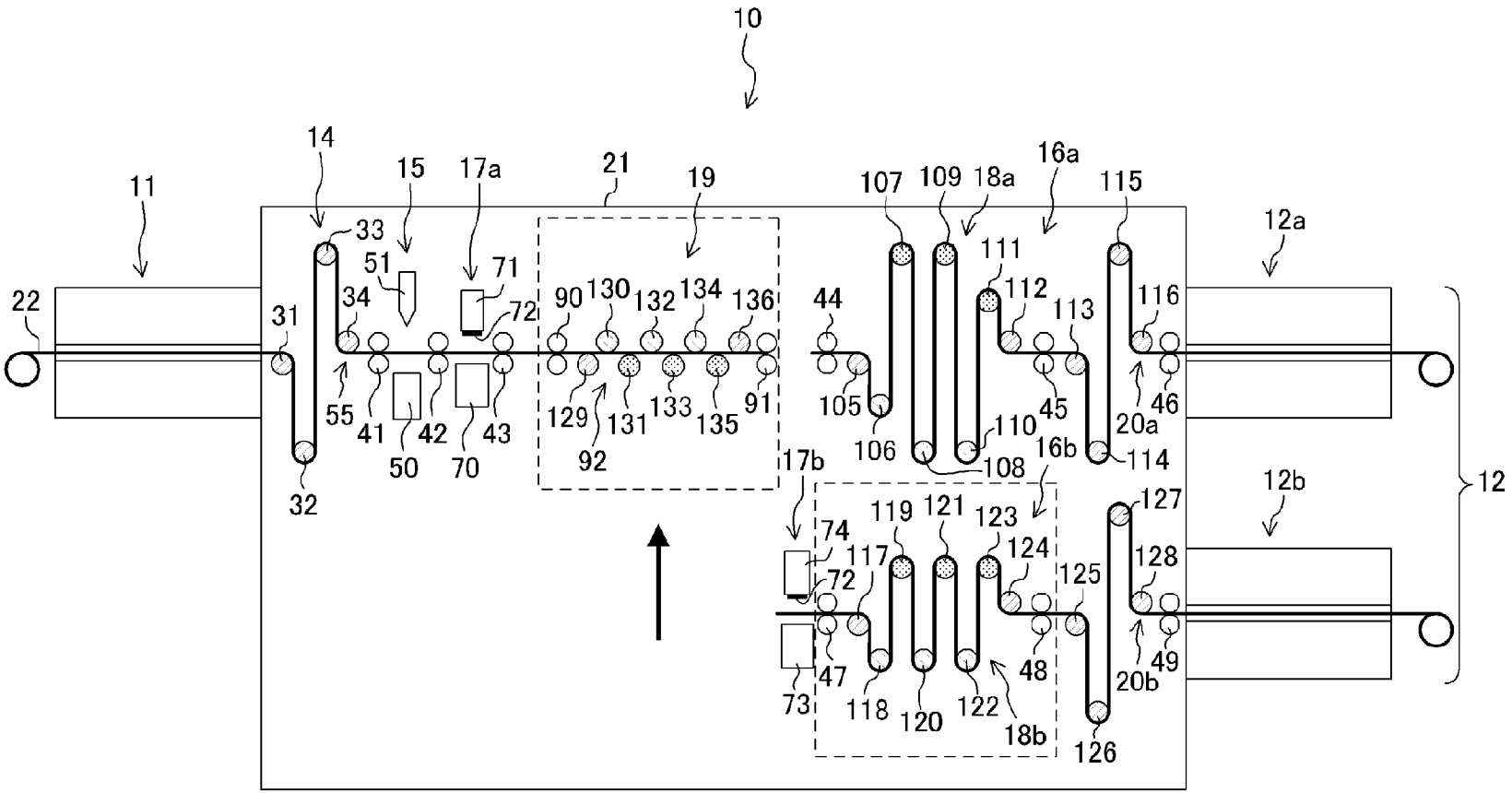
FIG. 5 is a schematic illustration of the base material processing device in which the route changing section moves from a position before a second B line base material conveying section to a position after a first base material conveying section.

Thereafter, as shown in FIG. 5, the route changing section 19 receives the plastic base material 22 from the first base material conveying section 14. The fifth to twelfth conveyance rolls 105 to 112 of the second A line base material supply adjusting section 18*a* move in the direction intersected with the conveyance direction of the plastic base material 22 to approach one another, thereby sending the plastic base material 22. Further, continuing from the state shown in FIG. 4, the seventeenth to twenty-fourth conveyance rolls 117 to 124 of the second B line base material supply adjusting section 18*b* moves in the direction intersected with the conveyance direction of the plastic base material 22 to approach one another, thereby sending the plastic base material 22.

Figure 6:
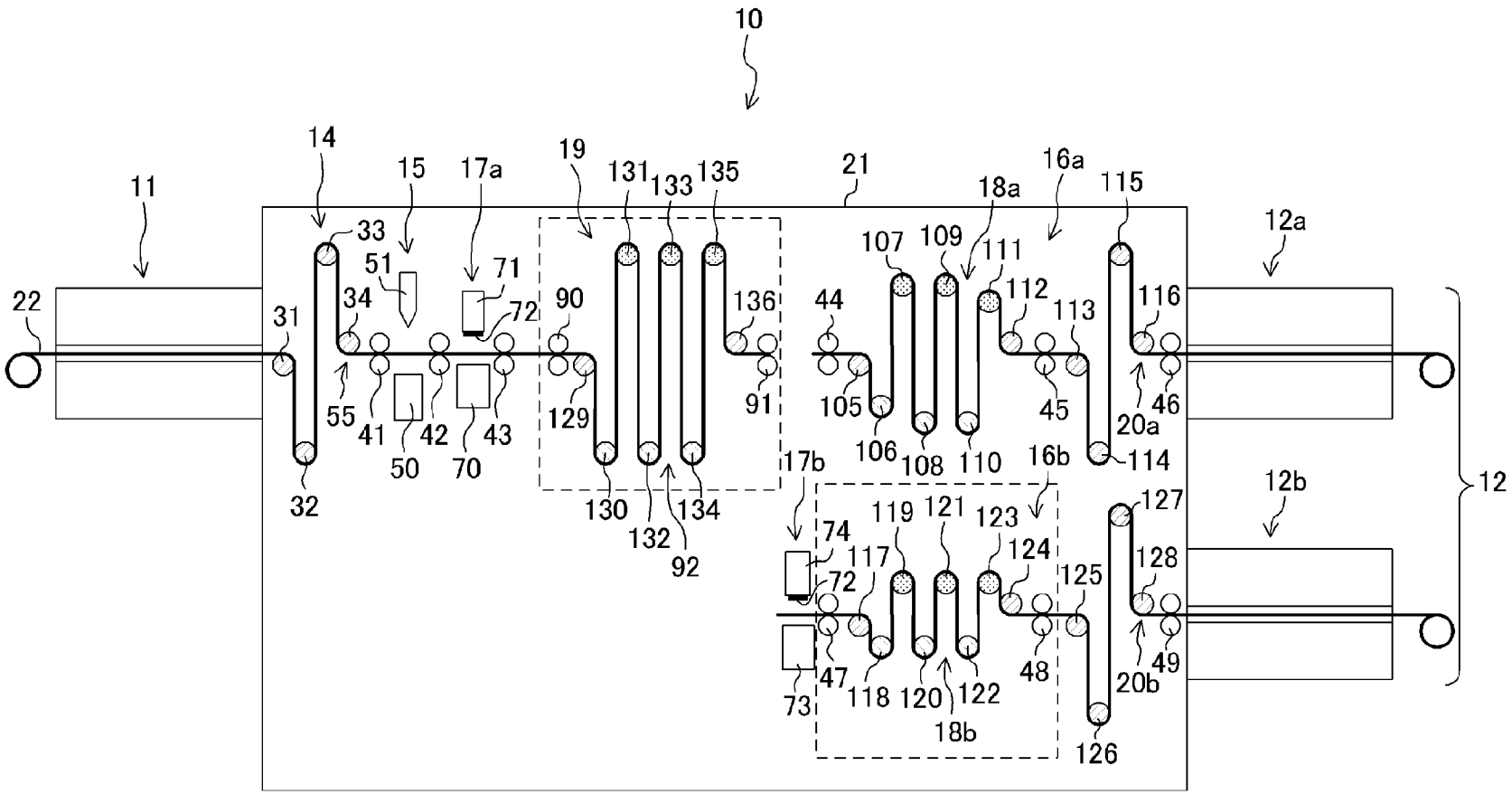
FIG. 6 is a schematic illustration of the base material processing device in which the route changing section receives the plastic base material from the first base material conveying section and holds it.

Next, as shown in FIG. 6, in the route changing section 19, the thirtieth to thirty-fifth conveyance rolls 130 to 135 of the fourth base material supply adjusting section 92 move away from one another in the direction intersected with the conveyance direction of the plastic base material 22 to hold the plastic base material 22 conveyed from the first base material conveying section 14. Further, continuing from the state shown in FIG. 5, the fifth to twelfth conveyance rolls 105 to 112 of the second A line base material supply adjusting section 18*a* and the seventeenth to twenty-fourth conveyance rolls 117 to 124 of the second B line base material supply adjusting section 18*b* move in the direction intersected with the conveyance direction of the plastic base material 22 to approach one another, thereby sending the plastic base material 22.

Figure 7:
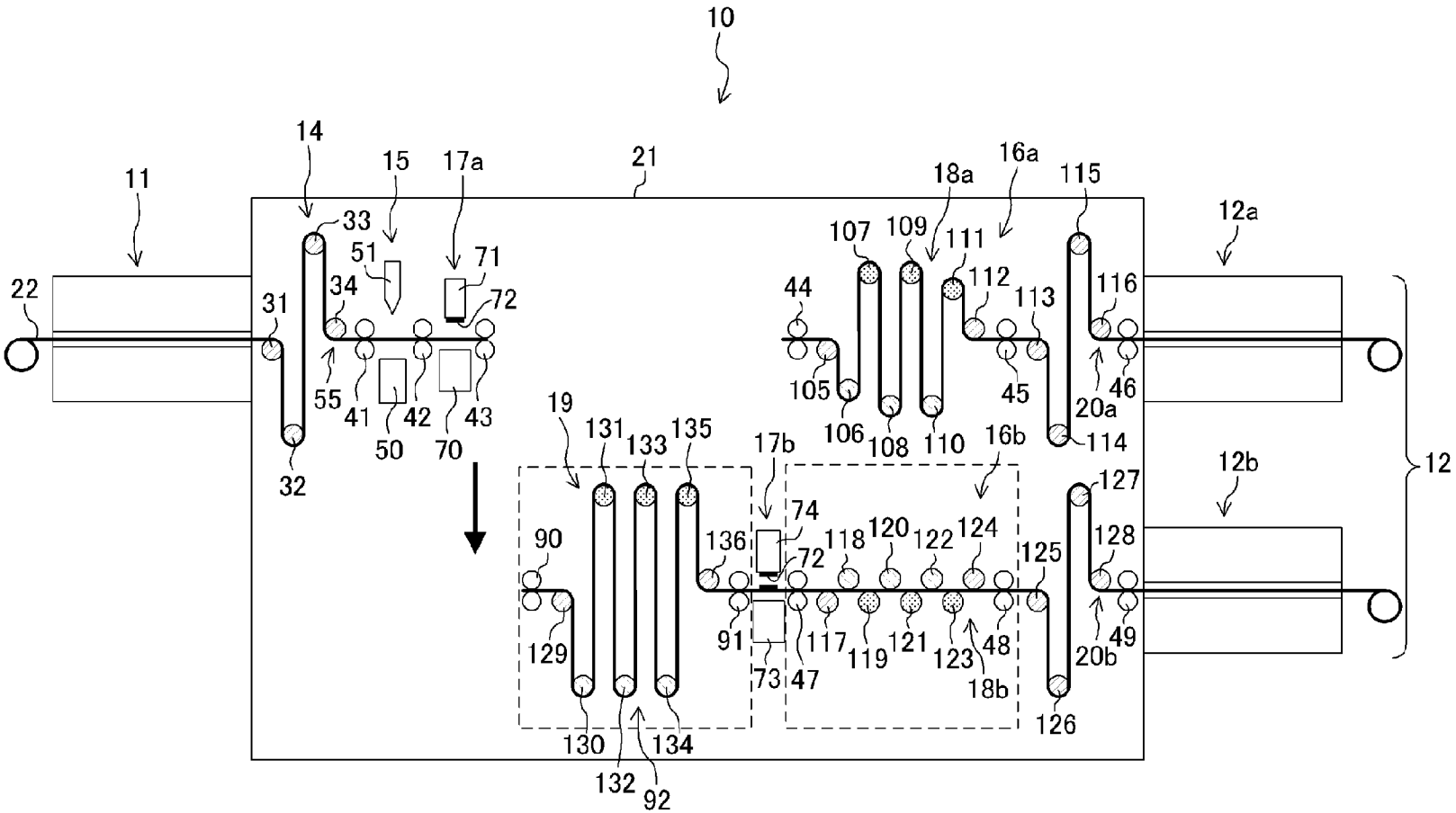
FIG. 7 is a schematic illustration of the base material processing device in which the route changing section moves from the position after the first base material conveying section to the position before the second B line base material conveying section while holding the plastic base material, which is divided by a base material dividing section.

Subsequently, as shown in FIG. 7, the base material dividing section 15 divides the plastic base material 22 at its predetermined point.

Thereafter, the route changing section 19 moves to the space before the second B line base material conveying section 16*b* while holding the plastic base material 22 thereinside.

Next, the second base material joining section 17*b* joins the start edge of the plastic base material 22 held by the moved route changing section 19 to the end edge of the plastic base material 22 held by the second B line base material supply adjusting section 18*b*. Further, continuing from the state shown in FIG. 6, the seventeenth to twenty-fourth conveyance rolls 117 to 124 of the second B line base material supply adjusting section 18*b* move in the direction intersected with the conveyance direction of the plastic base material 22 to approach one another, thereby sending the plastic base material 22.

Figure 8:
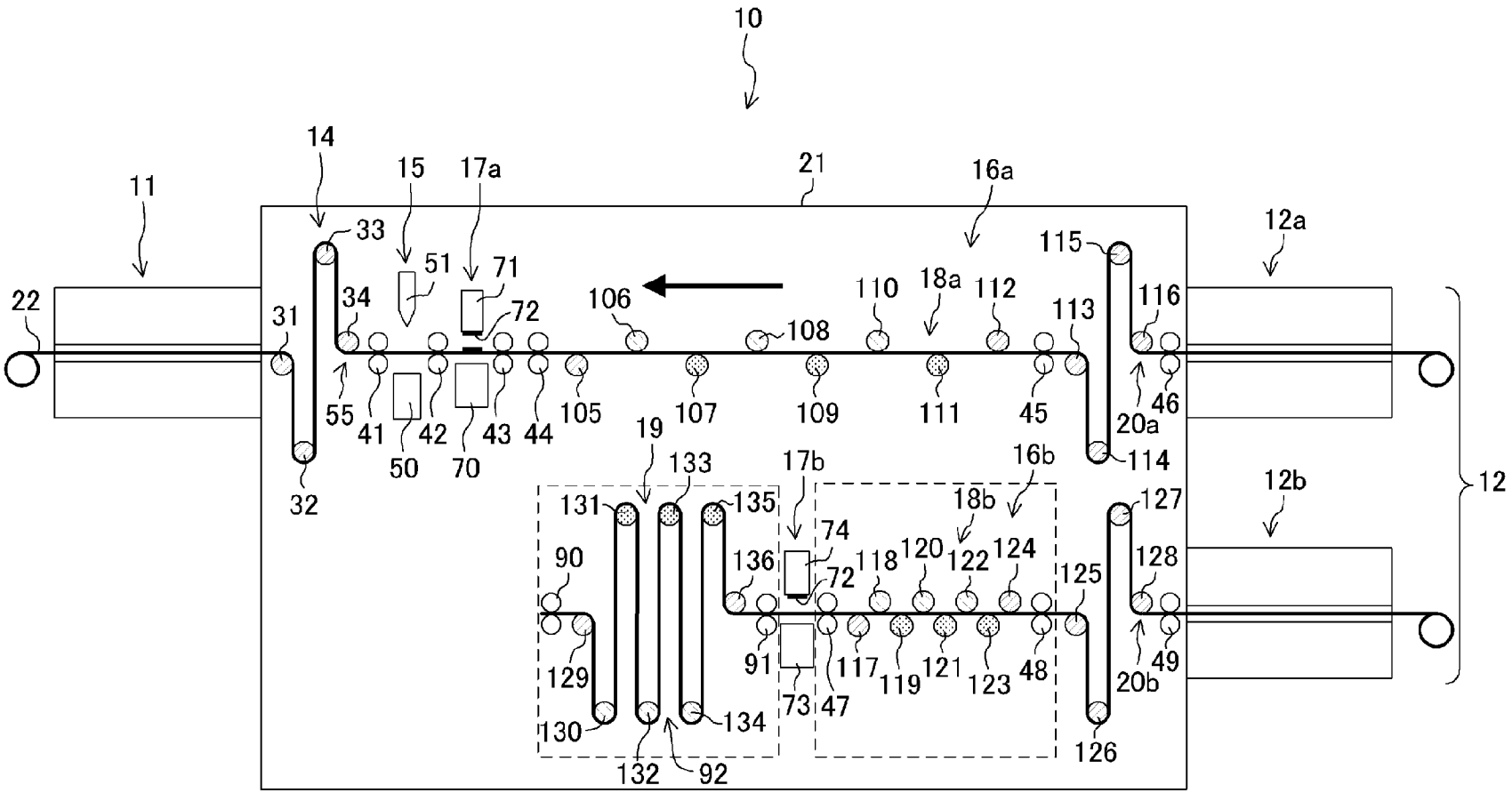
FIG. 8 is a schematic illustration of the base material processing device in which the second A line base material supply adjusting section extends to the first base material conveying section, and an end edge of the held plastic base material is joined to a start edge of the plastic base material which is formed by division in FIG. 7.

Subsequently, as shown in FIG. 8, the fifth to twelfth conveyance rolls 105 to 112 of the second A line base material supply adjusting section 18*a* move to increase the distances thereamong. Then, the end edge of the plastic base material 22 held by the second A line base material supply adjusting section 18*a* approaches the start edge of the plastic base material 22 in the first base material conveying section 14 which is formed by division by the base material dividing section 15, and the first base material joining section 17*a* joins them. During this time, the plastic base material 22 is sent from the route changing section 19 to the second B line base material conveying section 16*b*, thereby returning to the state shown in FIG. 1.

In this way, the base material processing device 10 allots the plastic base material 22 from the first line 11, and alternately conveys it to the second A line 12*a* and the second B line 12*b* in which the conveyance speed is one half of that in the first line 11. This can eliminate the need to stop any of the second A line 12*a* and the second B line 12*b* having the lower conveyance speed, thereby achieving efficient and continuous connection between the lines.

A plurality of lines (the second A line and the second B line) may be disposed on the same plane, or be in a spatial arrangement of upper and lower layers. The spatial arrangement can result in effective space utilization.

Example Preferred Embodiment 2

Next, a base material processing device 200 according to Example Preferred Embodiment 2 of the present invention will be described with reference to FIG. 9.

Figure 9:
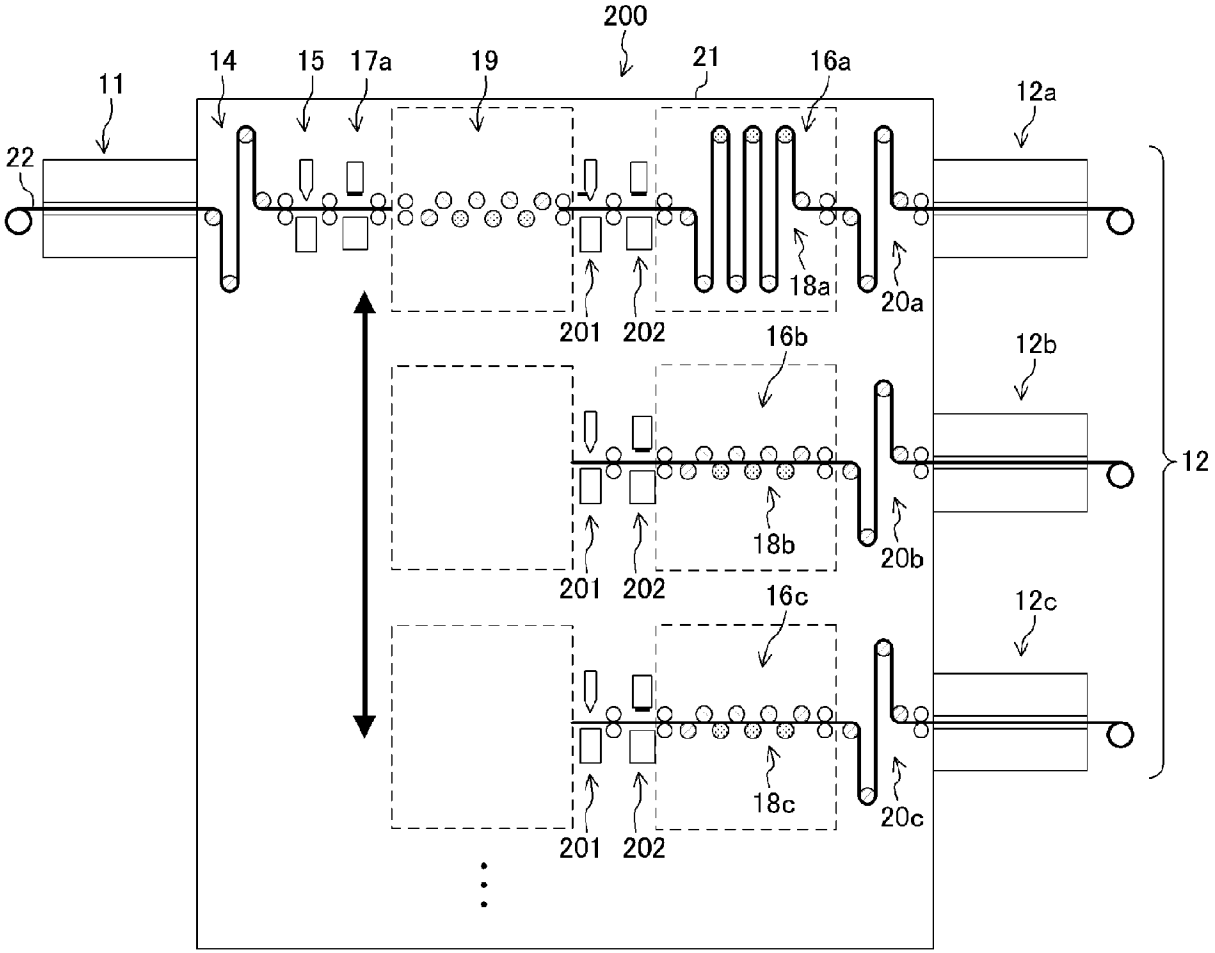
FIG. 9 is a schematic illustration of a base material processing device according to Example Preferred Embodiment 2 of the present invention.

As shown in FIG. 9, the base material processing device 200 performs line connection between a first line 11 and a second line 12 including three or more lines (a second A line 12*a*, a second B line 12*b*, a second C line 12*c*, and the like) arranged in parallel to one another. Even in the case where the second line includes three or more lines in this way, allocation of a plastic base material 22 from the first line by the route changing section 19 can result in continuous and efficient conveyance of the plastic base material 22, similarly to the case in Example Preferred Embodiment 1.

Here, similarly to the base material processing device 10 in Example Preferred Embodiment 1, the base material processing device 200 includes a first base material conveying section 14 including a first base material supply adjusting section 55, a base material dividing section 15, a first base material joining section 17*a*, a second A line base material conveying section 16*a* including a second A line base material supply adjusting section 18*a* and a third A line base material supply adjusting section 20*a*, a second B line base material conveying section 16*b* including a second B line base material conveying section 18*b* and a third B line base material supply adjusting section 20*b*, a route changing section 19, a chamber 21, and a control section not shown. The base material processing device 200 further includes a second C line base material conveying section 16*c* including a second C line base material supply adjusting section 18*c* and a third C line base material supply adjusting section 20*c* so as to correspond to the second C line 12*c*. On respective connection lines corresponding to the second A line 12*a*, the second B line 12*b*, and the second C line 12*c*, base material dividing sections 201 and base material joining sections 202 are provided between the spaces where the route changing section 19 is to be set and the second A line base material conveying section 16*a*, the second B line base material conveying section 16*b*, and the second C line base material conveying section 16*c*. In the base material processing device 200, the route changing section 19 receives the plastic base material 22 from the first base material conveying section 14, and moves among the spaces before the second A line base material conveying section 16*a*, the second B line base material conveying section 16*b*, and the second C line base material conveying section 16*c* while holding the received plastic base material 22, and then allots and conveys the plastic base material 22 to the plurality of lines of the second line 12.

Example Preferred Embodiment 3

As example base material processing methods using a base material processing device according to a preferred embodiment of the present invention, base material processing methods will be described next in the cases (A) where a problem occurs in the second line 12 and (B) where a problem occurs in the first line 11. The description herein refers, but is not limited, to the case of base material processing device 210 performing line connection between a first line and a second line including three or more lines arranged in parallel to each other. The base material processing device 10 where two lines are arranged in parallel in the second line may be used.

Figure 10:
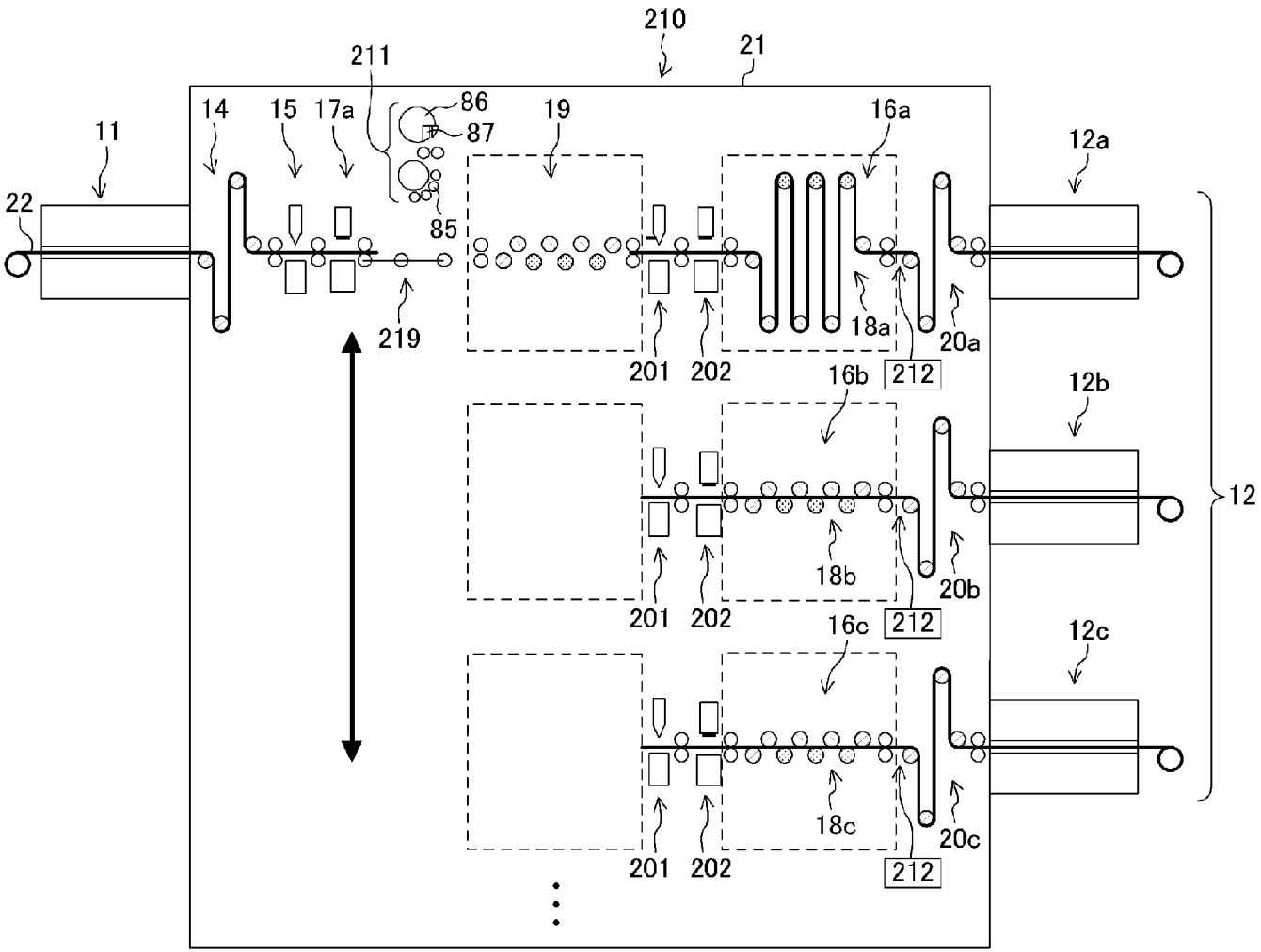
FIG. 10 is a schematic illustration of a base material processing device according to Example Preferred Embodiment 3 of the present invention.

As shown in FIG. 10, the base material processing device 210 is a base material processing device 200 according to Example Preferred Embodiment 2 to which a base material recovery section 211 and base material supply sections 212 are added.

The base material recovery section 211 is provided in a space after the third hold and conveyance roll pair 43 and above the conveyance route of the plastic base material 22. The base material recovery section 211 includes a plurality of guide rolls 85 receiving the plastic base material 22 and conveying it upward, and a winding roll 86 receiving the plastic base material 22 from the guide rolls 85 and winding and storing it. In the winding roll 86, a pinching section 87 is formed for pinching and holding the start edge of the plastic base material 22 received from the guide roll 85.

Figure 11:
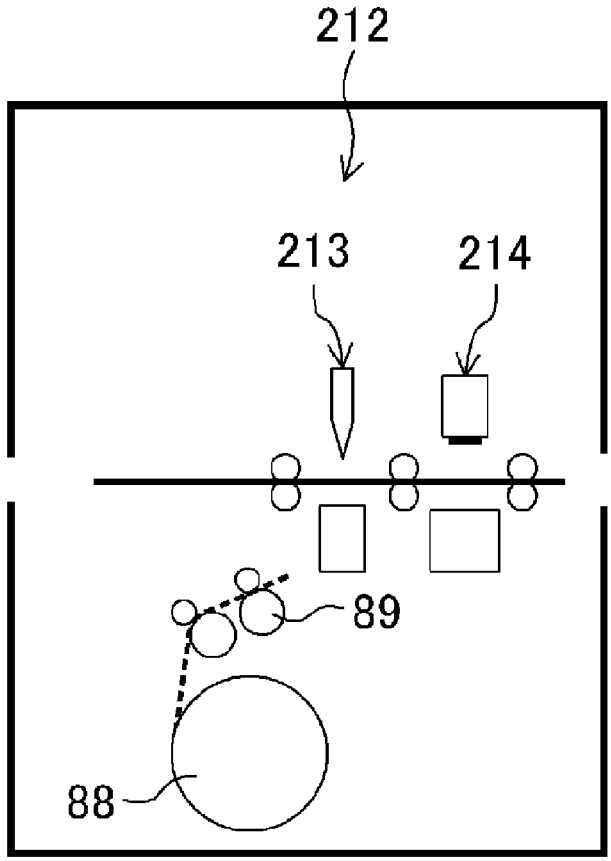
FIG. 11 is a schematic illustration of a base material supply section of the base material processing device according to Example Preferred Embodiment 3 of the present invention.

The base material supply sections 212 are located below the conveyance routes of the plastic base material 22 between the second A line base material supply adjusting section 18*a* and the third A line base material supply adjusting section 20*a*, between the second B line base material supply adjusting section 18*b* and the third B line base material supply adjusting section 20*b*, and between the second C line base material supply adjusting section 18*c* and the third C line base material supply adjusting section 20*c*. Each base material supply section 212 includes, as shown in FIG. 11, a winding roll 88 to wind and store a plastic base material 22 or a dummy base material to be supplied to the corresponding conveyance route. The dummy base material herein is a flexible base material prepared separately from the to-be-processed plastic base material 22, for example. It may be made of a material different from the to-be-processed plastic base material 22, or may be a base material made of the same material and having a defect or the like. A plastic base material 22 with no defect such as a flaw may be used, of course. Each base material supply section 212 further includes a plurality of guide rolls 89 arranged to guide the plastic base material 22 or the dummy base material supplied from the winding roll 88 to the corresponding conveyance route, a base material dividing section 213, and a base material joining section 214. To one roll of the third hold and conveyance roll pair 43, auxiliary conveyance rolls 219 for supporting and conveying the plastic base material 22 are fixed so as to turn about the one roll.

The base material recovery section 211 and the base material supply sections 212 are arranged on the opposite sides of the conveyance routes of the plastic base material 22. This arrangement can substantially eliminate interference between the base material recovery section 211 and the base material supply sections 212, thereby achieving effective space utilization.

It is noted that the base material recovery section 211 and the base material supply sections 212 may be arranged on the same side of the conveyance routes of the plastic base material 22, and may by arranged above the base material dividing section 15.

In the case where the base material supplying function is unnecessary, the base material supply sections 212 may be omitted from the base material processing device 210.

(A) A Base Material Processing Method in the Case where a Problem Occurs in the Second Line 12

In the case where a processing problem occurs in either line of the second line 12, and the line of the second line 12 and conveyance of the plastic base material 22 to the line should be stopped, the base material dividing section 15 divides the plastic base material 22 conveyed from the first line 11 first.

Next, the auxiliary conveyance rolls 219 fixed to the one roll of the third hold and conveyance roll pair 43 move and turn downward about the one roll, and the base material recovery section 211 descends. The descending base material recovery section 211 pulls the start edge of the plastic base material 22 which is formed by division by the base material dividing section 15 into the pinching section 87 through the guide rolls 85, and recovers it while pinching and holding it. During this time, a dummy base material is supplied to the end edge of the plastic base material 22 that is to be conveyed from the corresponding base material supply section 212 to the line of the second line 12 in which the processing problem occurs.

Subsequently, the start edge of the dummy base material supplied from the base material supply section 212 is joined to the end edge of the plastic base material 22 which is formed by division by the corresponding base material joining section 214 for continuous conveyance. When the plastic base material 22 advances to a predetermined route point, the second line 12 and conveyance of the plastic base material 22 to the second line 12 are stopped.

Accordingly, the second line 12 in which the processing problem occurs and conveyance of the plastic base material 22 to the second line 12 can be stopped with the plastic base material 22 from the first line 11 being conveyed continuously. If the problem is solved within a short period of time, it is possible that the dummy base material is joined to the plastic base material 22 from the first line 11 and is conveyed immediately without conveyance interruption.

(B) A Base Material Processing Method when a Problem Occurs in the First Line 11

Upon occurrence of a processing problem in the first line 11, the first line 11 and carry-in of the plastic base material 22 from the first line 11 are stopped first.

Next, the base material dividing section 15 divides the plastic base material 22 conveyed from the first line 11. At this time, if the processing problem in the first line 11 forms a processing failure portion in the plastic base material 22, a position detector provided in the base material dividing section 15 detects the processing failure portion for dividing the conveyed plastic base material 22 at its point immediately before the processing failure portion. This enables efficient recovery of a normally processed portion of the plastic base material 22.

Subsequently, a base material supply section 212 supplies another plastic base material 22 processed in advance in the first line 11 or a dummy base material to the end edge of the plastic base material 22 which is formed by division.

Thereafter, the base material joining section 214 joins the start edge of the other plastic base material 22 or the dummy base material supplied from the base material supply section 212 to the end edge of the plastic base material 22 which is formed by division, and the joined plastic base material 22 is conveyed to the second line 12.

Thus, in the case where a processing problem or the like occurs in, for example, the first line 11, the first line 11 and conveyance of the plastic base material 22 from the first line 11 to the second line 12 can be stopped with the plastic base material 22 being continuously conveyed to the second line 12.

The base material processing device 210 can be used effectively for base material processing not only upon occurrence of a problem in the first or second line, as described above, but also in maintenance.

Example Preferred Embodiment 4

Next, a base material processing device 300 and a base material processing method using it according to Example Preferred Embodiment 4 of the present invention will be described in detail with reference to the drawings. The same characters are assigned to the same elements as those in Example Preferred Embodiment 1, and description thereof is omitted.

Figure 12:
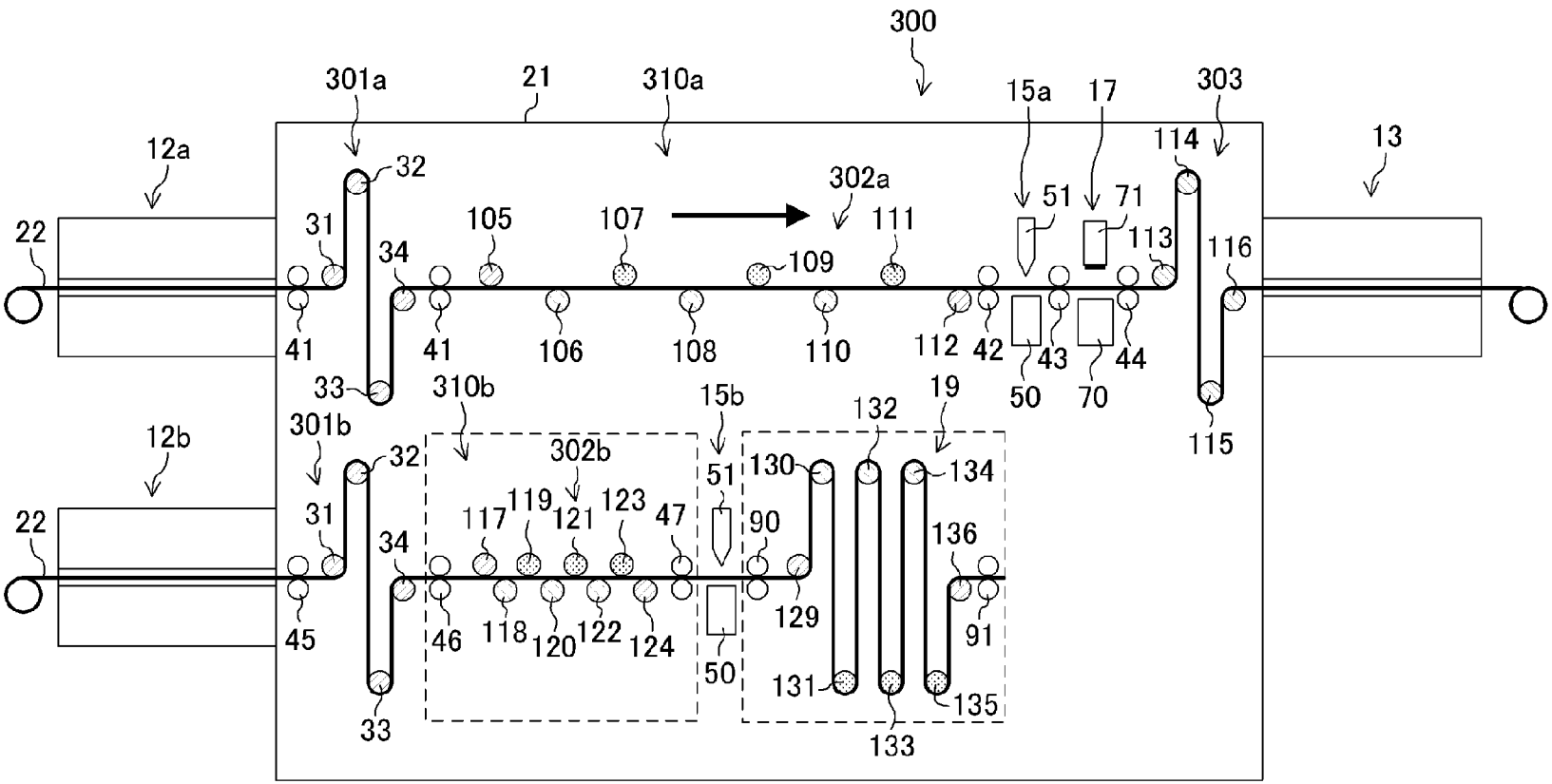
FIG. 12 is a schematic illustration of a base material processing device in which a second A line is connected to a third line, and the route changing section holds in its inside a plastic base material from a second B line.

FIG. 12 is a schematic illustration showing the base material processing device 300 according to Example Preferred Embodiment 4 of the present invention. The base material processing device 300 is provided, as shown in FIG. 2, between adjacent two process lines (a second line 12 and a third line 13) among a plurality of process lines. The second line 12 includes a second A line 12*a* and a second B line 12*b* which perform the same process and are arranged in parallel to each other.

The base material processing device 300 includes a first A line base material conveying section 310*a* including a first A line base material supply adjusting section 301*a* and a second A line base material supply adjusting section 302*a*, a first base material dividing section 15*a*, a base material joining section 17, a third base material supply adjusting section 303, a first B line base material conveying section 310*b* including a first B line base material supply adjusting section 301*b* and a second B line base material supply adjusting section 302*b*, a second base material dividing section 15*b*, a route changing section 19, a chamber 21, a control section not shown, and the like.

The first A line base material conveying section 310*a* is located at a position where the plastic base material 22 from the second A line 12 is received first. The first A line base material conveying section 310*a* includes the first A line base material supply adjusting section 301*a*, the second A line base material supply adjusting section 302*a*, and a first hold and conveyance roll pair 41.

The first A line base material supply adjusting section 301*a* includes first to fourth conveyance rolls 31, 32, 33, 34.

The second A line base material supply adjusting section 302*a* is located between the first hold and conveyance roll pair 41 and a second hold and conveyance roll pair 42. The second A line base material supply adjusting section 302*a* includes fifth to twelfth conveyance rolls 105 to 112.

The first base material dividing section 15*a* is located after the second hold and conveyance roll pair 42. The first base material dividing section 15*a* has a function of aligning the conveyed plastic base material 22. The first base material dividing section 15*a* includes a dividing stage 50, a cutter 51 or the like disposed above the dividing stage 50.

The base material joining section 17 is located after a third hold and conveyance roll pair 43. The base material joining section 17 has a function of aligning the conveyed plastic base material 22. The base material joining section 17 includes a joining stage 70 and a joint tape attaching section 71 disposed above the joining stage 70.

The third base material supply adjusting section 303 is located after the first A line base material conveying section 310*a* and before the third line 13. The third base material supply adjusting section 303 includes thirteenth to sixteenth conveyance rolls 113, 114, 115, 116.

The first B line base material conveying section 310*b* includes the first B line base material supply adjusting section 301*b*, the second B line base material supply adjusting section 302*b*, and fifth to seventh hold and conveyance roll pairs 45 to 47.

The first B line base material supply adjusting section 301*b* includes, similarly to the first A line base material supply adjusting section 301*a*, first to fourth conveyance rolls 31, 32, 33, 34.

The second B line base material supply adjusting section 302*b* is located between a sixth hold and conveyance roll pair 46 and a seventh hold and conveyance roll pair 47. The second B line base material supply adjusting section 302*b* includes seventeenth to twenty-fourth conveyance rolls 117 to 124.

The second base material dividing section 15*b* is located after the first B line base material conveying section 310*b*. The second base material dividing section 15*b* has a function of aligning the conveyed plastic base material 22. The second base material dividing section 15*b* includes a dividing stage 50, a cutter or the like disposed above the dividing stage 50.

A Display Device Manufacturing Method Using Base Material Processing Device 300

A display device manufacturing method using the base material processing device 300 according to Example Preferred Embodiment 4 of the present invention will be described next in detail.

As shown in FIG. 12, a continuous plastic base material 22 (a flexible base material), on one of the surfaces of which a film is formed, is conveyed from the second line 12 to the third line 13. The base material processing device 300 is provided between the second line 12 and the third line 13. The present example preferred embodiment refers to a display device manufacturing method in the case where the conveyance speed in the third line 13 is twice the conveyance speed in the second line 12, and the second line 12 includes a second A line 12*a* and a second B line 12*b* arranged in parallel to each other. The second A line 12*a*, the second B line 12*b*, and the third line 13 convey the plastic base material 22 continuously without a stop.

First, as shown in FIG. 12, in a state in which the route changing section 19 is positioned after the first B line base material conveying section 310*b*, continuous plastic base materials 22, for example, preferably having a thickness of about 200 μm and a width of about 105 mm and made of polyimide are carried into the base material processing device 300 from the first A line 12*a* and the second A line 12*b*

The plastic base material 22 carried in the second A line 12*a* passes through the first A line base material supply adjusting section 301*a* and the second A line base material supply adjusting section 302*a* of the first A line base material conveying section 310*a*, and the third base material supply adjusting section 303, and is then conveyed to the third line 13.

The plastic base material 22 carried in the second B line 12*b* passes through the first B line base material supply adjusting section 301*b* and the second B line base material supply adjusting section 302*b* of the first B line base material conveying section 310*b*, and is then held in the route changing section 19.

Next, the first base material dividing section 15*a* and the second base material dividing section 15*b* divide the plastic base material 22 from the second A line 12*a* and the plastic base material 22 from the second B line 12*b*, respectively.

Figure 13:
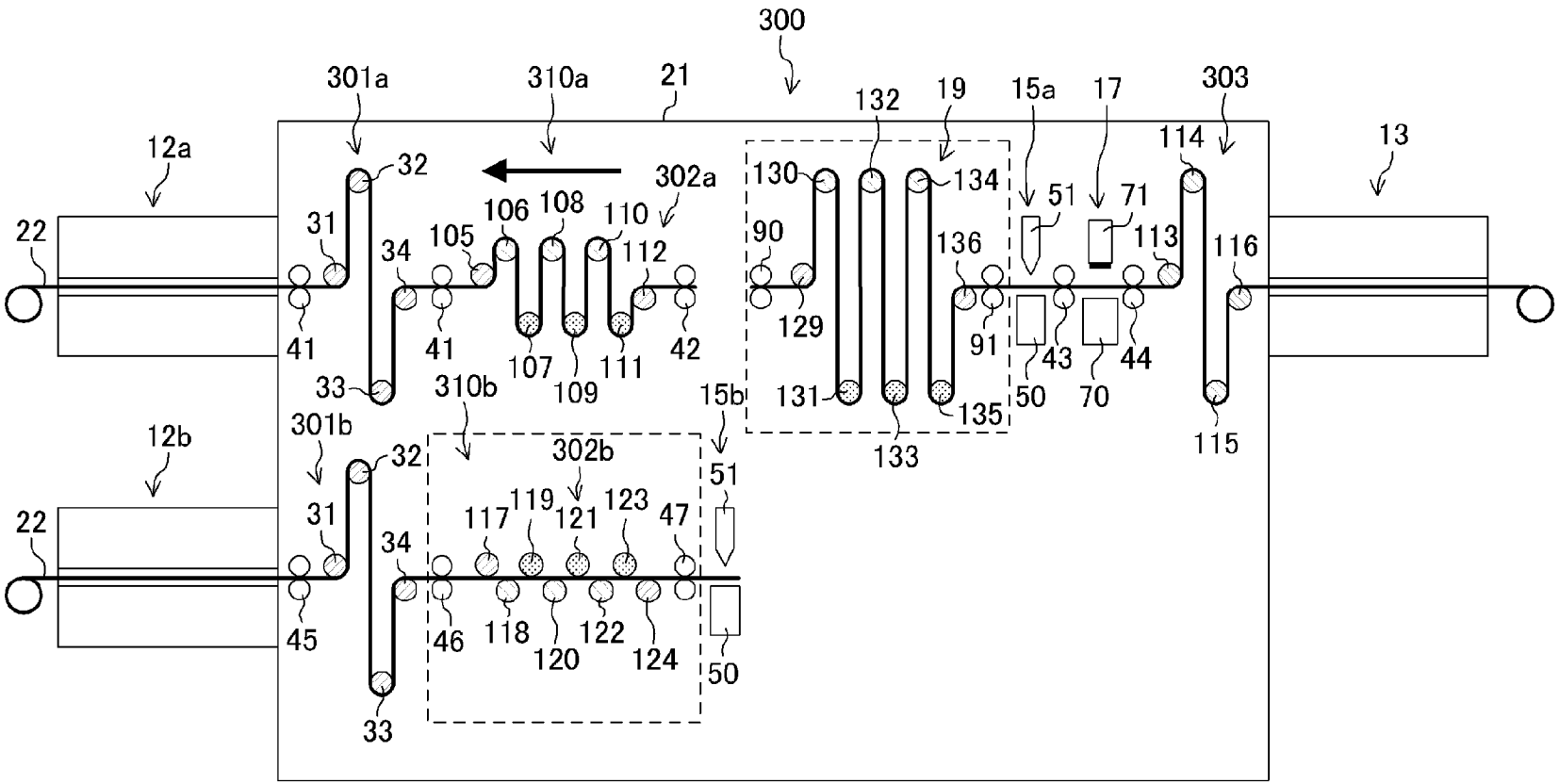
FIG. 13 is a schematic illustration of the base material processing device in which the route changing section moves from a position after the first B line base material conveying section to a position before a third line base material supply adjusting section while holding the plastic base material, which is divided by a second base material dividing section.

Subsequently, as shown in FIG. 13, the fifth to twelfth conveyance rolls 105 to 112 of the second A line base material supply adjusting section 302*a* move in the conveyance direction of the plastic base material 22 to approach the first A line base material supply adjusting section 301*a* for reducing the distances thereamong, while moving away from one another in the direction intersected with the conveyance direction of the plastic base material 22, thereby holding the plastic base material 22.

In addition, at the same time when the distances among the fifth to twelfth conveyance rolls 105 to 112 are reduced, the route changing section 19 moves to the space between the contracting second A line base material supply adjusting section 302*a* and the first base material dividing section 15*a*.

Thereafter, the base material joining section 17 joins the start edge of the plastic base material 22 held by the moved route changing section 19 to the end edge of the plastic base material 22 which is formed by division by the first base material dividing section 15*a*.

During this time, the first B line base material supply adjusting section 301*b* holds the plastic base material 22 continuously conveyed from the second B line 12*b*.

Figure 14:
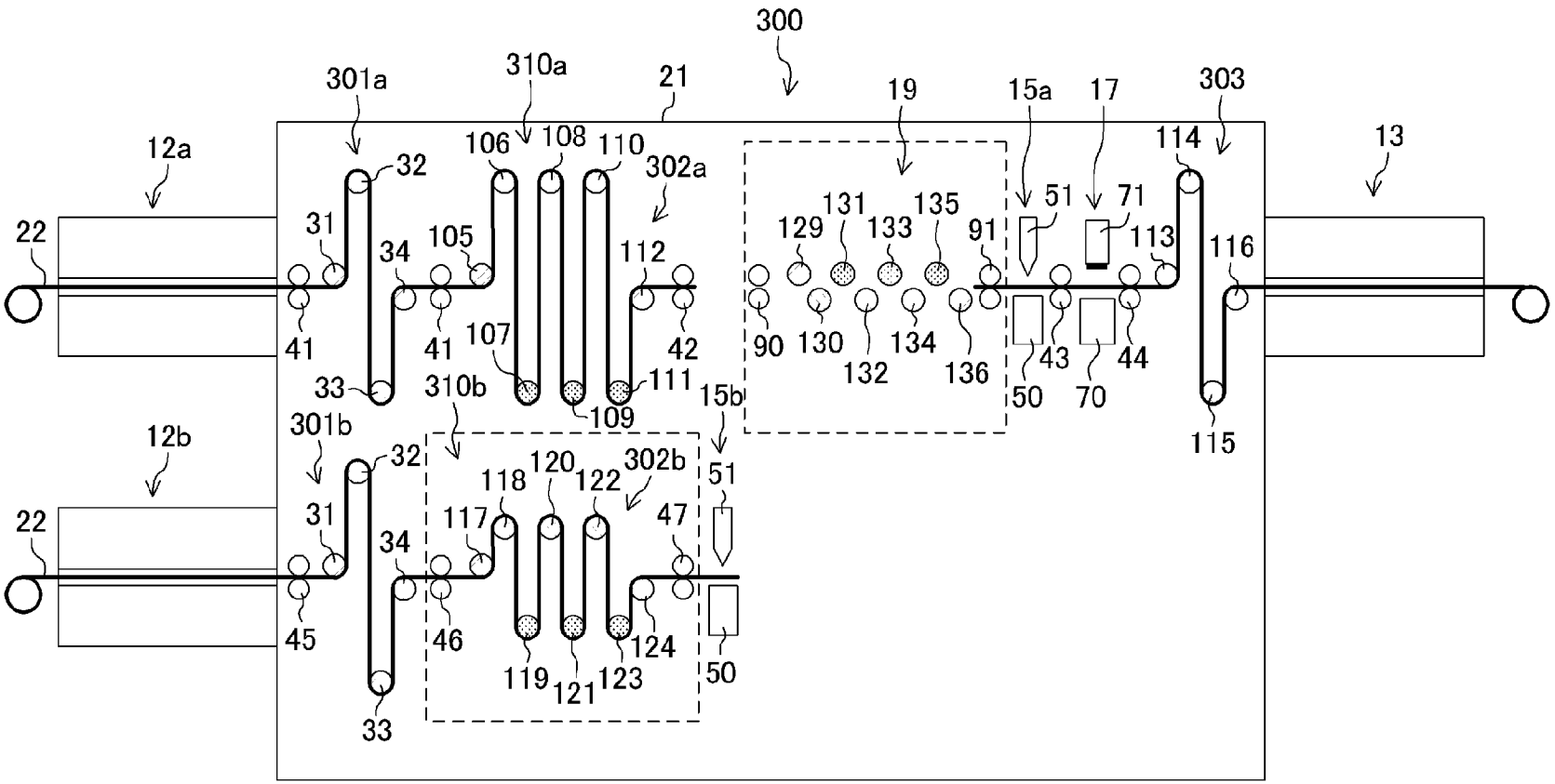
FIG. 14 is a schematic illustration of the base material processing device in which the plastic base material held by the route changing section is sent out thoroughly.

Next, as shown in FIG. 14, the thirtieth to thirty-fifth conveyance rolls 130 to 135 of the fourth base material supply adjusting section 92 in the route changing section 19 approach one another in the direction intersected with the conveyance direction of the plastic base material 22 to send out the held plastic base material 22 to the third base material supply adjusting section 303.

During this time, the second A line base material supply adjusting section 302*a* holds the plastic base material 22 continuously conveyed from the second A line 12*a*, and the first B line base material supply adjusting section 301*b* continues to hold the plastic base material 22 continuously conveyed from the second B line 12*b*.

Figure 15:
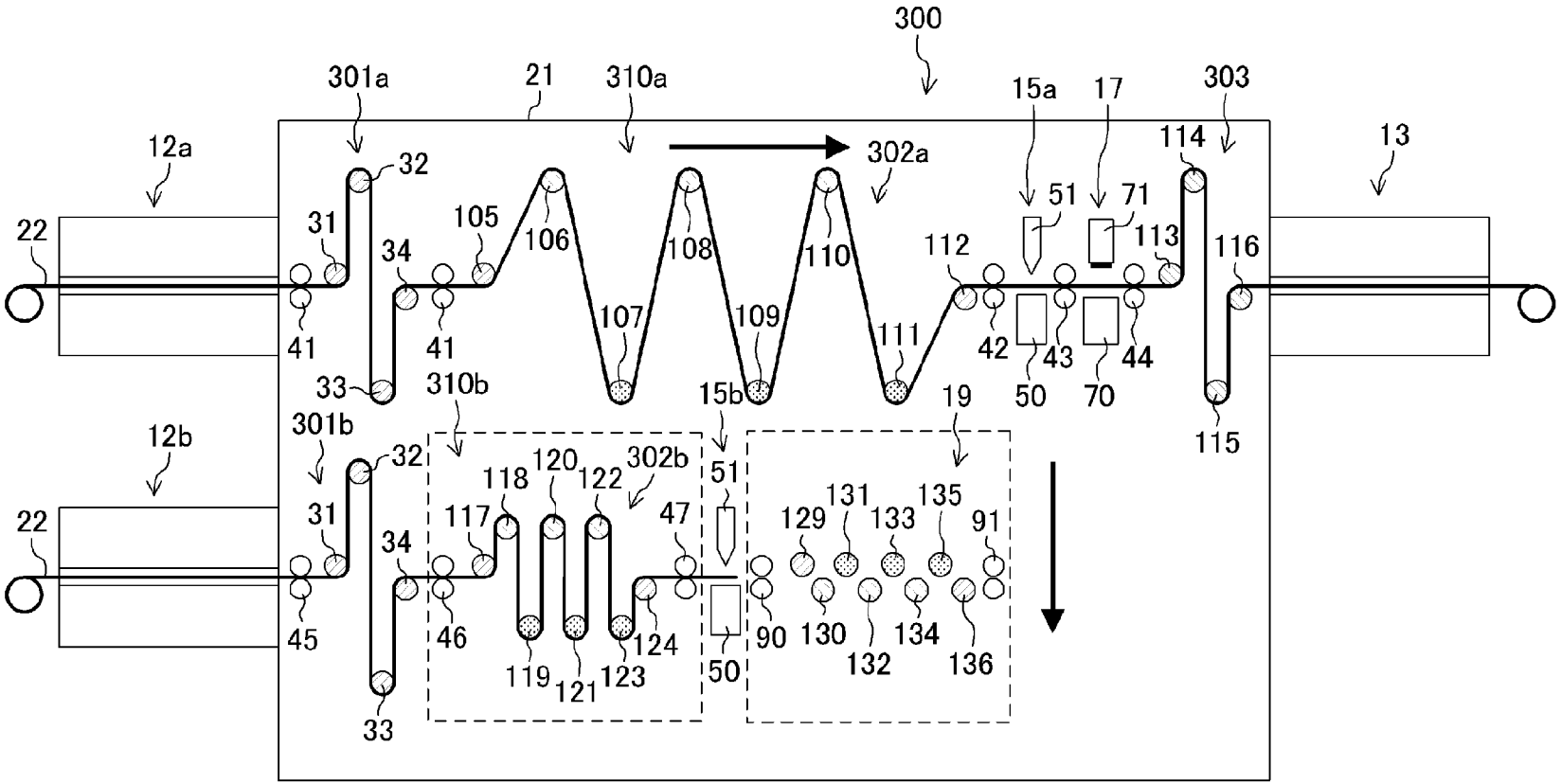
FIG. 15 is a schematic illustration of the base material processing device in which the route changing section moves, while a second A line base material supply adjusting section extends, and a start edge of the held plastic base material is joined to the end edge of the plastic base material formed by division in FIG. 13.

Subsequently, as shown in FIG. 15, the route changing section 19 that has thoroughly sent out the held plastic base material 22 moves to the space after the first B line base material conveying section 310*b*.

Thereafter, the fifth to twelfth conveyance rolls 105 to 112 of the second A line base material supply adjusting section 302*a* move to increase the distances thereamong so that the start edge of the held plastic base material 22 approaches the end edge of the plastic base material 22 held by the third base material supply adjusting section 303, and then, the base material joining section 17 joins them.

Figure 16:
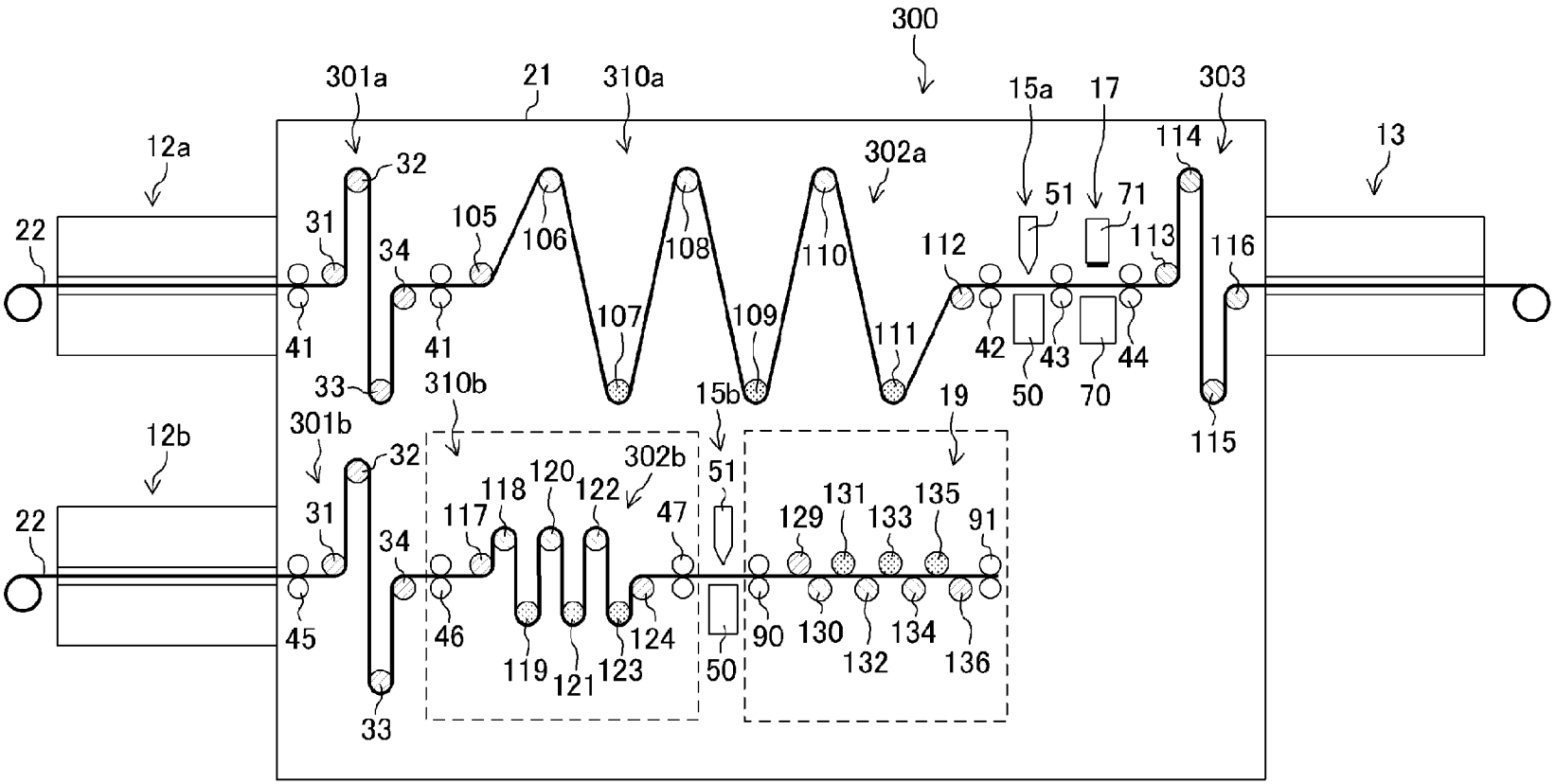
FIG. 16 is a schematic illustration of the base material processing device in which the plastic base material is conveyed from a first B line base material conveying section to the route changing section.

Next, as shown in FIG. 16, the seventeenth to twenty-fourth conveyance rolls 117 to 124 of the second B line base material supply adjusting section 302*b* move in the direction intersected with the conveyance direction of the plastic base material 22 to approach one another, thereby sending the plastic base material 22 to the route changing section 19.

Figure 17:
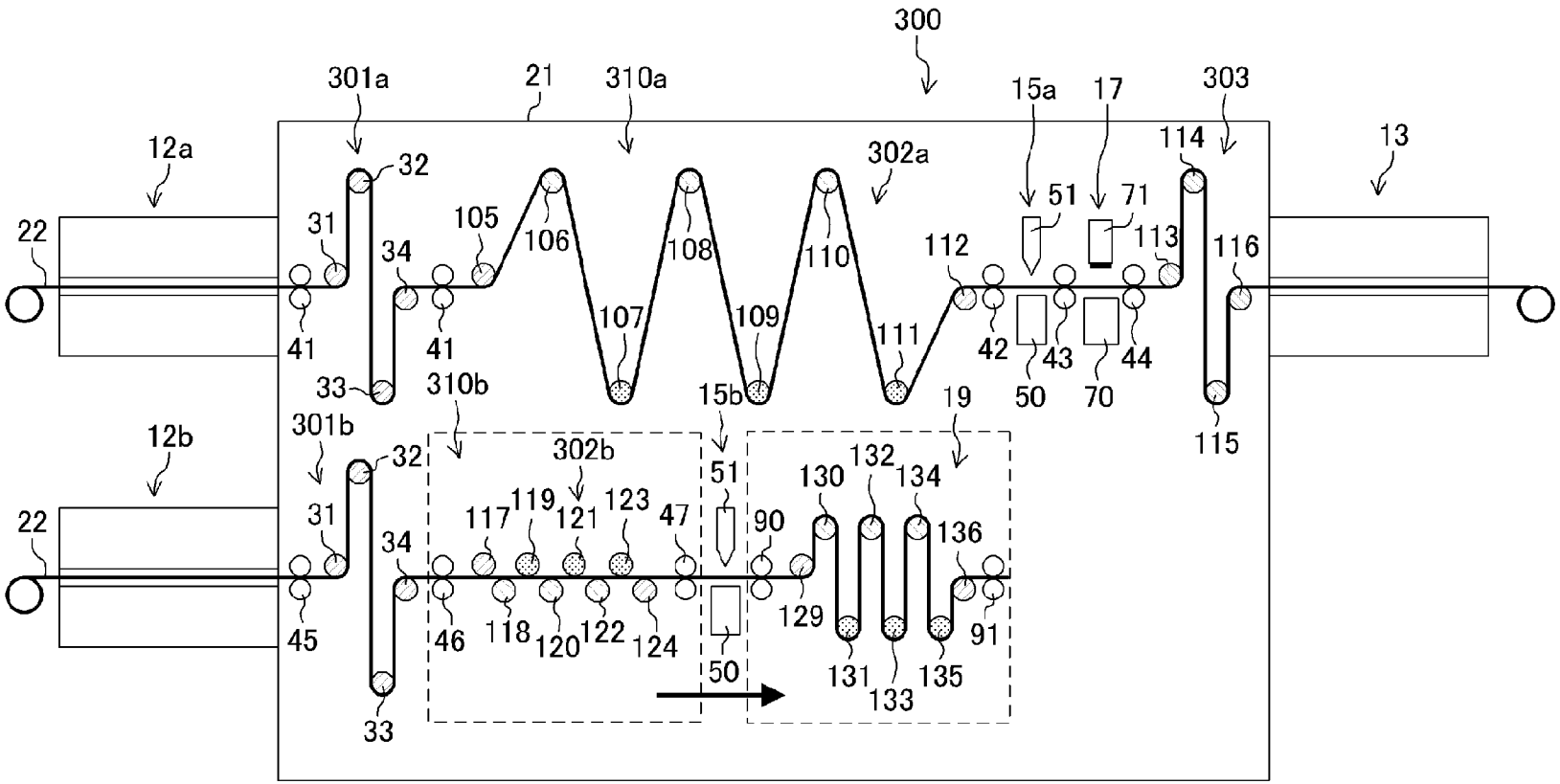
FIG. 17 is a schematic illustration of the base material processing device in which the route changing section holds the plastic base material sent from the first B line base material conveying section.

Subsequently, as shown in FIG. 17, the thirtieth to thirty-fifth conveyance rolls 130 to 135 of the fourth base material supply adjusting section 92 in the route changing section 19 moves away from one another in the direction intersected with the conveyance direction of the plastic base material 22 to hold the plastic base material 22 sent from the second B line base material supply adjusting section 302*b*.

In the state shown in FIGS. 16 and 17, the plastic base material 22 from the second A line 12*a* is being continuously conveyed to the third line 13 through the first A line base material conveying section 310*a* and the third base material supply adjusting section 303.

Thereafter, the fifth to twelfth conveyance rolls 105 to 112 of the second A line base material supply adjusting section 302*a* approach one another in the direction intersected with the conveyance direction of the plastic base material 22 to send the held plastic base material 22 to the third base material supply adjusting section 303, thereby returning to the original state shown in FIG. 12.

Thus, conveyance of the plastic base materials 22 from the second A and B lines 12*a*, 12*b* to the third line 13 in which the conveyance speed is twice that in the second line 12 is changed alternately in the base material processing device 300. This can eliminate the need to stop either the second A line 12*a* or the second B line 12*b* in which the conveyance speed is lower, thereby achieving efficient continuous line connection.

It is noted that the base material processing device according to a preferred embodiment of the present invention can be effectively used for manufacturing display devices, such as LCDs (liquid crystal display panels), PDs (plasma display panels), organic ELs (organic electroluminescence elements), and SEDs (surface-conduction electron-emitter displays), and the like. Besides the display devices, any devices can be manufactured only if they are manufactured by processing a flexible base material conveyed in the roll-to-roll system.

Further, the base material processing device may additionally include a cleaning section arranged to clean the plastic base material 22 after the base material dividing section(s).

Moreover, in the base material processing device, the base material dividing section may include a position detector arranged to detect a base material division point.

Furthermore, the route changing section 19 may not be movable between the conveyance routes as above. For example, a plurality of conveyance rolls changeable in their positions may be combined, thereby changing the conveyance route.

In addition, each of the first to third lines 11, 12 (12*a*, 12*b*, 12*c*), 13 includes at least one apparatus, and a plurality of apparatuses may be connected when necessitated.

In the above example preferred embodiments, the to-be-processed flexible base materials preferably are the plastic base materials 22, but may be organic base materials (polyester sulfone (PES), polyethylene naphthalate (PEN), polyimide (PI), polycarbonate (PC), polyacrylate (PA), polyethylene terephthalate (PET)), metal foil base materials (stainless, inconel, invar, etc.), inorganic/organic composite base materials, and the like.

Yet in the above example preferred embodiments, the dummy base material made of polyimide is preferably used as the other flexible base material to be connected to the to-be-processed flexible base material. However, any base materials having flexibility may be used, such as organic base materials, inorganic/organic composite base materials, metal foil base materials, and the like.

ADVANTAGES

Advantages obtained in the base material processing device and the base material processing methods according to preferred embodiments of the present invention will be described next.

The base material processing device according to a preferred embodiment of the present invention is a base material processing device, which is provided between a first line and a second line whose numbers of lines are different from each other, for line connection through processing conveyed continuous flexible base materials, including: a first base material conveying section configured to receive from the first line and convey a to-be-processed flexible base material; a base material dividing section configured to divide the flexible base material from the first line conveyed by the first base material conveying section; a route changing section configured to receive the flexible base material from its base material start edge formed by division by the base material dividing section, and configured to change to the second line a conveyance route on which the received flexible base material is conveyed; and a second base material conveying section located before the second line, and configured to hold the to-be-processed flexible base material and to convey the held flexible base material to the second line.

In the above configuration, the base material processing device performing line connection between the first line and the second line includes the route changing section for changing the conveyance route of the flexible base material. Accordingly, when a problem or the like occurs in the first line or the second line, the conveyance route can be changed to a separately prepared substitute line. This may eliminate the need to stop all the lines upon occurrence of a problem or the like in some line. Further, when an urgent production increase is necessitated, for example, the number of lines included in the first line or the second line whichever has a slower processing speed, is increased, and the conveyance route is changed to any of the increased lines to increase processing efficiency of the flexible base material. Thus, the urgent production increase can be addressed. In addition, since the route connecting the process lines is continuous, it is unnecessary to wind the flexible base material by a roll-shaped winder or the like every time a process is performed in each process line, and to roll out therefrom and convey the base material to the next process line. Hence, no difference in processing waiting time (retention time) may be generated within the continuous flexible base material, thereby preventing occurrence of a base material processing failure.

The base material processing device according to a preferred embodiment of the present invention may further include a first base material joining section configured to join a base material start edge of the flexible base material whose route is changed by the route changing section to a base material end edge of the flexible base material held by the second base material conveying section.

In this configuration, the first base material joining section is provided which is configured to join a base material start edge of the flexible base material whose route is changed by the route changing section to a base material end edge of the flexible base material held by the second base material conveying section. Accordingly, continuous conveyance of the flexible base material whose route is changed and the flexible base material held by the second base material conveying section can be ensured.

In the base material processing device according to a preferred embodiment of the present invention, the base material dividing section may divide the flexible base material received and held by the route changing section at its predetermined point, and the route changing section may be configured to move between conveyance routes while holding the flexible base material divided by the base material dividing section.

In this configuration, the base material dividing section divides the flexible base material received and held by the route changing section at its predetermined point, and the route changing section is configured to move between conveyance routes while holding the flexible base material divided by the base material dividing section. Accordingly, even when the second line, for example, includes a plurality of lines to which the flexible base material received from the first line is to be allotted, smooth allotment of the flexible base material can be achieved. Further, even when the first line includes a plurality of lines and the flexible base materials are conveyed sequentially to the second line by line change, smooth change of the flexible base materials can be achieved.

The base material processing device according to a preferred embodiment of the present invention may further include a second base material joining section configured to join a base material start edge of the flexible base material from the first line which is formed by dividing the flexible base material received and held by the route changing section to a base material end edge of the flexible base material having conveyed before route change by the route changing section.

In this configuration, the second base material joining section is provided which configured to join a base material start edge of the flexible base material from the first line which is formed by dividing the flexible base material received and held by the route changing section to a base material end edge of the flexible base material having conveyed before route change by the route changing section. Hence, the connection between the lines can be returned to the original state after route change of the conveyed flexible base material.

In the base material processing device according to a preferred embodiment of the present invention, the first base material conveying section and/or the second base material conveying section may include a base material supply adjusting section configured to receive, hold, and then send the flexible base material from the first line or to receive while sending it.

With this configuration, the base material supply adjusting section can arbitrarily adjust the flexible base material carry-in speed from the first line and the flexible base material carry-out speed to the second line. Consequently, even when, for example, either the first or second line is stopped for maintenance and then is operated again, the conveyance speed of the flexible base material in the other line can be kept constant. Further, even when the processing speed in the first line is different from that in the second line, adjustment of the conveyance speed of the flexible base material by the base material supply adjusting section can achieve smooth connection between the lines.

In the base material processing device according to a preferred embodiment of the present invention, the base material supply adjusting section may include base material supply adjusting rolls configured to vary the conveyance route of the flexible base material by reciprocating in a direction intersected with a direction in which the flexible base material is conveyed while rotating and coming in contact with a surface of the flexible base material.

In the above configuration, the base material supply adjusting section includes base material supply adjusting rolls configured to vary the conveyance route of the flexible base material by reciprocating in a direction intersected with a direction in which the flexible base material is conveyed while rotating and coming in contact with a surface of the flexible base material. Hence, base material supply can be adjusted with this simple mechanism.

In the base material processing device according to a preferred embodiment of the present invention, the base material supply adjusting rolls may be configured to adjust an interval therebetween in a direction in which the flexible base material conveys.

With this configuration, by reducing the distances between the base material supply adjusting rolls, the route changing section can be smoothly housed on the connection line with it holding the flexible base material divided by the base material dividing section. Further, when the base material supply adjusting rolls increase the distances therebetween after the route changing section moves from the connection line to the other line with it holding the flexible base material divided by the base material dividing section, the start edge of the flexible base material from the first line can be smoothly joined to the end edge of the flexible base material conveyed before the route changing section changes the route.

In the base material processing device according to a preferred embodiment of the present invention, the base material supply adjusting rolls may be configured to come in contact with only a surface on a non-processed side of the conveyed flexible base material.

In this configuration, the base material supply adjusting rolls are configured to come in contact with only a surface on a non-processed side of the conveyed flexible base material. Accordingly, damage and the like to the to-be-processed surface of the flexible base material can be prevented.

In the base material processing device according to a preferred embodiment of the present invention, the first base material conveying section and/or the second base material conveying section may include conveyance rolls configured to convey the flexible base material by rotating while coming into contact with a surface of the flexible base material.

In this configuration, the first base material conveying section and/or the second base material conveying section includes conveyance rolls configured to convey the flexible base material by rotating while coming into contact with a surface of the flexible base material. Accordingly, the flexible base material can be conveyed by such a simple mechanism.

In the base material processing device according to a preferred embodiment of the present invention, the conveyance rolls may be configured to come in contact with only a surface on a non-processed side of the conveyed flexible base material.

In this configuration, the conveyance rolls are configured to come in contact with only a surface on a non-processed side of the conveyed flexible base material. Accordingly, damage and the like to the to-be-processed surface of the flexible base material can be prevented.

In the base material processing device according to a preferred embodiment of the present invention, the base material dividing section may divide the flexible base material by using laser light or a cutter.

In this configuration, the base material dividing section divides the flexible base material by using the laser light or the cutter, thereby achieving efficient division of the flexible base material.

In the base material processing device according to a preferred embodiment of the present invention, the base material dividing section may divide the flexible base material by utilizing water pressure.

In this configuration, the base material dividing section divides the flexible base material by utilizing water pressure, thereby achieving efficient division of the flexible base material and removal of foreign matter.

The base material processing device according to a preferred embodiment of the present invention may further include a cleaning section provided after the base material dividing section and configured to clean the flexible base material.

In this configuration, the cleaning section configured to clean the flexible base material is provided after the base material dividing section. Accordingly, debris of the base material and the like which may adhere to the base material after division can be removed, thereby achieving favorable manufacturing yield and the like.

The base material processing device according to a preferred embodiment of the present invention may further include a chamber configured to house the first and second base material conveying sections, the base material dividing section, and the route changing section.

In this configuration, the chamber configured to house the first and second base material conveying sections, the base material dividing section, and the route changing section is provided. Hence, adhesion of foreign matter and the like from outside to the base material can be prevented effectively, thereby achieving favorable manufacturing yield.

The base material processing device according to a preferred embodiment of the present invention may further include an alignment member arranged to adjust a position where the first base material joining section joins the base materials.

In this configuration, the alignment member is arranged to adjust a position where the first base material joining section joins the base materials, thereby ensuring joining of the base materials at their desired positions The base material processing device according to a preferred embodiment of the present invention may further include an alignment member arranged to adjust a position where the base material dividing section divides the base material.

In this configuration, the alignment member is arranged to adjust a position where the base material dividing section divides the base material, thereby ensuring division of the base material at desired positions.

The base material processing device according to a preferred embodiment of the present invention may further include a base material recovery section configured to recover the flexible base material from its base material start edge formed by division by the base material dividing section; base material supply sections configured to supply a flexible base material and/or a flexible base material prepared separately from the flexible base material to a base material end edge formed by division by the base material dividing section; and a third base material joining section configured to join the base material end edge to a base material start edge of the flexible base material and/or the flexible base material prepared separately from the flexible base material, which are supplied from the base material supply sections.

In this configuration, when a processing problem occurs in, for example, the second line, and the second line and conveyance of the base material to the second line should be stopped, the flexible base material conveyed from the first line is divided first. Then, the base material recovery section recovers the flexible base material continuously conveyed through the first line from the start edge of the divided flexible base material. During this time, a separately prepared flexible base material (e.g., a dummy base material constituted by another base material, or a flexible base material made of the same material and having a defect) is joined to the end edge of the flexible base material being conveyed to the second line, and is continuously conveyed. Then, when it advances to a predetermined point of the route, the second line and conveyance of the base material to the second line are stopped. As a result, while conveyance of the flexible base material from the first line can be continued, the second line in which the processing problem occurs and conveyance of the flexible base material to the second line can be stopped. Further, upon occurrence of a processing problem in the first line, the first line is stopped, and the flexible base material conveyed from the first line is divided. Then, a base material supply section supplies the flexible base material and/or the dummy base material to the end edge of the flexible base material which is formed by division, and its start edge is joined to the end edge, and is conveyed to the second line. Thus, even when conveyance of the flexible base material from the first line in which the processing problem occurs is stopped, the conveyance of the flexible base material to the second line can be continued.

In the base material processing device according to a preferred embodiment of the present invention, the base material recovery section may include a winding roll configured to wind and store the recovered flexible base material.

In this configuration, the base material recovery section includes a winding roll configured to wind and store the recovered flexible base material, thereby achieving a compact base material recovery section.

In the base material processing device according to a preferred embodiment of the present invention, the base material supply sections may include a winding roll configured to winding and store for supplying the flexible base material and/or the flexible base material prepared separately from the flexible base material.

In this configuration, the base material supply sections include a winding roll configured to winding and store for supplying the flexible base material and/or the flexible base material prepared separately from the flexible base material, thereby implementing a compact base material supply section.

In the base material processing device according to a preferred embodiment of the present invention, the base material recovery section may be located above a position where the base material dividing section divides the base material.

Debris of the base material and the like generated by division of the base material may fall on and adhere to the to-be-recovered base material. However, with the above configuration, since the base material recovery section is located above a position where the base material dividing section divides the base material, such falling and adhesion can be prevented effectively. Hence, the recovered base material can be reused in a favorable state.

In the base material processing device according to the present invention, the base material supply sections may be located above a position where the base material dividing section divides the base material.

Debris of the base material and the like generated by division of the base material may fall on and adhere to the supplied base material. However, with the above configuration, since the base material supply sections are located above a position where the base material dividing section divides the base material, such falling and adhesion can be prevented effectively. Hence, the supplied base material can be used in a favorable state.

In the base material processing device according to a preferred embodiment of the present invention, the base material recovery section and the base material supply sections may be located on the same side of conveyance routes of the flexible base material and the flexible base material prepared separately from the flexible base material.

In this configuration, the base material recovery section and the base material supply sections are located on the same side of the conveyance routes of the flexible base material and the flexible base material prepared separately from the flexible base material. Hence, the base material recovered in the base material recovery section can be easily moved to a base material supply section, thereby achieving favorable manufacturing efficiency.

In the base material processing device according to a preferred embodiment of the present invention, the base material dividing section may further include position detector arranged to detect a base material division point.

In this configuration, the base material dividing section further includes position detector configured to detect a base material division point. Accordingly, when a processing problem occurs in, for example, the first line, and a processing failure portion is form in the flexible base material, the conveyed flexible base material can be divided at its point immediately before the processing failure portion. Hence, a portion of the flexible base material which has been processed normally can be recovered efficiently.

Another base material processing device according to the present example preferred embodiment is a base material processing device, which is provided between a first line comprised of a single line and a second line comprised of a plurality of lines, for line connection through processing conveyed continuous flexible base materials, including: a first base material conveying section configured to receive from the first line and convey a to-be-processed flexible base material; a base material dividing section configured to divide the flexible base material from the first line conveyed by the first base material conveying section; a route changing section configured to receive the flexible base material from its base material start edge formed by division by the base material dividing section and to change a conveyance route on which the received flexible base material is conveyed to the second line; and a plurality of second base material conveying sections located before the plurality of lines in the second line and configured to hold a to-be-processed flexible base material and convey the flexible base material to the second line.

In the above configuration, the base material processing device for performing connection between the first line and the second line includes the route changing section for changing the conveyance route of the flexible base material. Accordingly, when a problem or the like occurs in some line of the second line, the conveyance route can be changed to a separately prepared substitute line in the second line. This may eliminate the need to stop all the lines upon occurrence of a problem or the like in some line. Further, when an urgent production increase is necessitated, the number of lines included in the second line is increased, and the conveyance route is changed to any of the increased lines to increase processing efficiency of the flexible base material. Thus, the urgent production increase can be addressed. In addition, since the route connecting the process lines is continuous, it is unnecessary to wind the flexible base material by a roll-shaped winder or the like every time a process is performed in each process line, and to roll out therefrom and convey the base material to the next process line. Hence, no difference in processing waiting time (retention time) may be generated within the continuous flexible base material, thereby preventing occurrence of base material processing failure.

Still another base material processing device according to a preferred embodiment of the present invention is a base material processing device, which is provided between a first line comprised of a plurality of lines and a second line comprised of a single line, for line connection through processing conveyed continuous flexible base materials, including: a plurality of first base material conveying sections configured to receive from the corresponding lines of the first line and convey to-be-processed flexible base materials; a base material dividing section configured to divide the flexible base materials from the first line conveyed by the plurality of first base material conveying sections; a route changing section configured to receive a flexible base material from its base material start edge formed by division by the base material dividing section and to change a conveyance route on which the received flexible base material is conveyed to the second line; and a second base material conveying section located before the second line and configured to hold a to-be-processed flexible base material and convey the held to-be-processed flexible base material to the second line.

In the above configuration, the base material processing device for performing connection between the first line and the second line includes the route changing section for changing the conveyance route of the flexible base material. Accordingly, when a problem or the like occurs in the first line, the conveyance route can be changed to a separately prepared substitute line. This may eliminate the need to stop all the lines upon occurrence of a problem or the like in some line. Further, when an urgent production increase is necessitated, the number of lines included in the first line is increased, and the conveyance route is changed to any of the increased lines to increase processing efficiency of the flexible base material. Thus, the urgent production increase can be addressed. In addition, since the route connecting the process lines is continuous, it is unnecessary to wind the flexible base material by a roll-shaped winder or the like every time a process is performed in each process line, and to roll out therefrom and convey the base material to the next process line. Hence, no difference in processing waiting time (retention time) may be generated in the continuous flexible base material, thereby preventing occurrence of base material processing failure.

A base material processing method according to a preferred embodiment of the present invention is a base material processing method for performing line connection through processing to-be-processed continuous flexible base materials between a first line and a second line whose numbers of lines are different from each other, including: a first base material conveying step of receiving from the first line and conveying a to-be-processed flexible base material; a first base material dividing step of dividing the flexible base material conveyed from the first line in the first base material conveying step; a route changing step of receiving the flexible base material from its base material start edge formed by division in the first base material dividing step, and changing a conveyance route on which the flexible base material is conveyed to the second line; and a conveyance preparing step of holding for conveying to the second line a flexible base material before the second line.

In this configuration, the base material processing method includes the route changing step of changing the conveyance route in line connection between the first line and the second line. Accordingly, when a problem or the like occurs in the first line or the second line, the conveyance route can be changed to a separately prepared substitute line. This may eliminate the need to stop all the lines upon occurrence of a problem or the like in some line. Further, when an urgent production increase is necessitated, the number of lines included in one of the first line and the second line, which has a lower processing speed, for example, is increased, and the conveyance route is changed to any of the increased lines to increase processing efficiency of the flexible base material. Thus, the urgent production increase can be addressed. In addition, since the route connecting the process lines is continuous, it is unnecessary to wind the flexible base material by a roll-shaped winder or the like every time a process is performed in each process line, and to roll out therefrom and convey the base material to the next process line. Hence, no difference in processing waiting time (retention time) may be generated in the continuous flexible base material, thereby preventing occurrence of base material processing failure.

The base material processing method according to a preferred embodiment of the present invention may further include a first base material joining step of joining a base material start edge of the flexible base material whose route is changed in the route changing step to a base material end edge of the flexible base material held in the conveyance preparing step.

In this configuration, the method further includes the first base material joining step of joining a base material start edge of the flexible base material whose route is changed in the route changing step to a base material end edge of the flexible base material held in the conveyance preparing step. Accordingly, continuous conveyance of the flexible base material whose route is changed and the flexible base material held by the second base material conveying section can be ensured.

The base material processing method according to a preferred embodiment of the present invention may further include a second base material dividing step of dividing the flexible base material received and held in the route changing step at its predetermined point, wherein in the route changing step, the flexible base material divided in the second base material dividing step is moved to a predetermined conveyance route.

In this configuration, the second base material dividing step of dividing the flexible base material received and held in the route changing step at its predetermined point is provided, wherein in the route changing step, the flexible base material divided in the second base material dividing step is moved to a predetermined conveyance route. Accordingly, even when, for example, the second line includes a plurality of lines to which the flexible base material received from the first line is allotted, smooth allotment of the flexible base material can be achieved. Further, even when the first line includes a plurality of lines and the flexible base materials are conveyed sequentially to the second line by line change, smooth change of the flexible base materials can be achieved.

The base material processing method according to a preferred embodiment of the present invention may further include a second base material joining step of joining a base material start edge formed by dividing the flexible base material from the first line received and held in the route changing step to a base material end edge of the flexible base material having conveyed before route change in the route changing step.

In this configuration, the method further includes the second base material joining step of joining a base material start edge formed by dividing the flexible base material from the first line received and held in the route changing step to a base material end edge of the flexible base material having conveyed before route change in the route changing step. Hence, connection between the lines can be returned to the original state after route change of the conveyed flexible base material.

In the base material processing method, the flexible base materials may be joined by fusing.

In this configuration, the flexible base materials are joined by fusing, thereby achieving easy and favorable joining of the flexible base materials.

In the base material processing method, the flexible base materials may be joined with a chemical resistant tape.

In this configuration, the flexible base materials are joined with a chemical resistant tape. Accordingly, in performing a process, such as etching or the like using a chemical in the second line, corrosion of the tape by the chemical can be prevented, thereby favorably maintaining the adhesiveness of the tape.

In the base material processing method, the flexible base materials may be joined with a heat resistant tape.

In this configuration, the flexible base materials are joined with a heat resistant tape. Accordingly, in performing heat treatment in the second line, degradation of the adhesiveness of the tape by heating can be prevented, thereby favorably maintaining the adhesiveness of the tape.

The base material processing method according to a preferred embodiment of the present invention may further include: a base material recovering step of recovering the flexible base material from its base material start edge formed by division in the first or second base material dividing step; a base material supplying step of supplying a flexible base material and/or a flexible base material prepared separately from the flexible base material to a base material end edge formed by division in the first or second base material dividing step; and a third base material joining step of joining the base material end edge to a base material start edge of the flexible base material and/or the flexible base material prepared separately from the flexible base material, which are supplied in the base material supplying step.

In this configuration, when a processing problem occurs, for example, in the second line, and the second line and conveyance of the base material to the second line should be stopped, the flexible base material conveyed from the first line is divided first. Then, the flexible base material continuously conveyed through the first line is recovered from its start edge. During this time, the dummy base material or the like prepared separately from the flexible base material is joined to the end edge of the flexible base material being conveyed to the second line, and is continuously conveyed. Then, when it advances to a predetermined point of the route, the second line and conveyance of the base material to the second line are stopped. As a result, while conveyance of the flexible base material from the first line can be continued, the second line in which the processing problem occurs and conveyance of the flexible base material to the second line can be stopped. Further, upon occurrence of a processing problem in the first line, the first line is stopped, and the flexible base material conveyed from the first line is divided. Then, the flexible base material and/or the dummy base material is supplied to the end edge of the flexible base material which is formed by division, and its start edge is joined to the end edge and is conveyed to the second line. Thus, even when conveyance of the flexible base material from the first line in which the processing problem occurs is stopped, the conveyance of the flexible base material to the second line can be continued.

In the base material processing method according to a preferred embodiment of the present invention, in the first or second base material dividing step, the flexible base material may be divided through detection of a predetermined division point of the conveyed flexible base material.

In this configuration, the flexible base material is divided through detection of a predetermined division point of the conveyed flexible base material in the first or second base material dividing step. Accordingly, when a processing problem occurs in, for example, the first line, thereby forming a processing failure portion in the flexible base material, the conveyed flexible base material can be divided at its point immediately before the processing failure portion. As a result, a portion of the flexible base material which is processed normally can be recovered efficiently.

Another base material processing method according to a preferred embodiment of the present invention is a base material processing method for performing line connection through processing conveyed to-be-processed continuous flexible base materials between a first line comprised of a single line and a second line comprised of a plurality of lines, including: a base material conveying step of receiving from the first line and conveying a to-be-processed flexible base material; a base material dividing step of dividing the flexible base material conveyed from the first line in the first base material conveying step; a route changing step of receiving the flexible base material from its base material start edge formed by division in the base material dividing step, and changing a conveyance route on which the received flexible base material is conveyed to the second line; a conveyance preparing step of holding for conveying to the second line flexible base materials before the lines included in the second line; and a base material joining step of joining a base material start edge of the flexible base material whose route is changed in the route changing step to any one of the flexible base materials held in the conveyance preparing step.

In the above configuration, the route changing step of changing the conveyance route of the flexible base material is provided in the line connection between the first line and the second line. Accordingly, when a problem or the like occurs in some line of the second line, the conveyance route can be changed to a separately prepared substitute line in the second line. This may eliminate the need to stop all the lines upon occurrence of a problem or the like in some line. Further, when an urgent production increase is necessitated, the number of lines included in the second line is increased, and the conveyance route is changed to any of the increased lines to increase processing efficiency of the flexible base material. Thus, the urgent production increase can be addressed. In addition, since the route connecting the process lines is continuous, it is unnecessary to wind the flexible base material by a roll-shaped winder or the like every time a process is performed in each process line, and to roll out therefrom and convey the base material to the next process line. Hence, no difference in processing waiting time (retention time) may be generated within the continuous flexible base material, thereby preventing occurrence of base material processing failure.

Yet another base material processing method according to a preferred embodiment of the present invention is a base material processing method for performing line connection through processing to-be-processed continuous flexible base materials between a first line comprised of a plurality of lines and a second line comprised of a single of line, including: plurality of base material conveying steps of receiving and conveying to-be-processed flexible base materials from the corresponding lines of the first line; a base material dividing step of dividing the flexible base materials conveyed from the plurality of lines of the first line in the base material conveying steps; a route changing step of receiving a flexible base material from its base material start edge formed by division in the base material dividing step, and changing a conveyance route for the received flexible base material; a conveyance preparing step of holding for conveying to the second line a flexible base material before the second line; and a first base material joining step of joining a base material start edge of the flexible base material whose route is changed in the route changing step to a base material end edge of the flexible base material held in the conveyance preparing step.

In the above configuration, the route changing step of changing the conveyance route of the flexible base material is provided in the line connection between the first line and the second line. Accordingly, when a problem or the like occurs in the first line, the conveyance route can be changed to a separately prepared substitute line. This may eliminate the need to stop all the lines upon occurrence of a problem or the like in some line. Further, when an urgent production increase is necessitated, the number of lines included in the first line is increased, and the conveyance route is changed to any of the increased lines to increase processing efficiency of the flexible base material. Thus, the urgent production increase can be addressed. In addition, since the route connecting the process lines is continuous, it is unnecessary to wind the flexible base material by a roll-shaped winder or the like every time a process is performed in each process line, and to roll out therefrom and convey the base material to the next process line. Hence, no difference in processing waiting time (retention time) may be generated within the continuous flexible base material, thereby preventing occurrence of base material processing failure.

As described above, preferred embodiments of the present invention are useful in a base material processing device and base material processing methods using such a device.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A base material processing method for performing line connection through processing to-be-processed continuous flexible base materials between a first line and a second line whose numbers of lines are different from each other, comprising:

a first base material conveying step of receiving from the first line and conveying a to-be-processed flexible base material;

a first base material dividing step of dividing the flexible base material conveyed from the first line in the first base material conveying step;

a route changing step of receiving the flexible base material from its base material start edge formed by division in the first base material dividing step, and changing a conveyance route on which the flexible base material is conveyed to the second line;

a conveyance preparing step of holding for conveying to the second line a flexible base material before the second line; and a first base material joining step of joining a base material start edge of the flexible base material whose route is changed in the route changing step to a base material end edge of the flexible base material held in the conveyance preparing step.

2. The method of claim 1, further comprising a second base material dividing step of dividing the flexible base material received and held in the route changing step at its predetermined point, wherein in the route changing step, the flexible base material divided in the second base material dividing step is moved to a predetermined conveyance route.

3. The method of claim 2, further comprising a second base material joining step of joining a base material start edge formed by dividing the flexible base material from the first line received and held in the route changing step to a base material end edge of the flexible base material having conveyed before route change in the route changing step.

4. The method of claim 1, wherein the flexible base materials are joined by fusing.

5. The method of claim 1, wherein the flexible base materials are joined with a chemical resistant tape.

6. The method of claim 1, wherein the flexible base materials are joined with a heat resistant tape.

7. The method of claim 1, further comprising:

a base material recovering step of recovering the flexible base material from its base material start edge formed by division in the first or second base material dividing step;

a base material supplying step of supplying a flexible base material and/or a flexible base material prepared separately from the flexible base material to a base material end edge formed by division in the first or second base material dividing step; and a third base material joining step of joining the base material end edge to a base material start edge of the flexible base material and/or the flexible base material prepared separately from the flexible base material, which are supplied in the base material supplying step.

8. The method of claim 7, wherein in the first or second base material dividing step, the flexible base material is divided through detection of a predetermined division point of the conveyed flexible base material.

9. A base material processing method for performing line connection through processing conveyed to-be-processed continuous flexible base materials between a first line comprised of a single line and a second line comprised of a plurality of lines, comprising:

a base material conveying step of receiving from the first line and conveying a to-be-processed flexible base material;

a base material dividing step of dividing the flexible base material conveyed from the first line in the first base material conveying step;

a route changing step of receiving the flexible base material from its base material start edge formed by division in the base material dividing step, and changing a conveyance route on which the received flexible base material is conveyed to the second line;

a conveyance preparing step of holding for conveying to the second line flexible base materials before the lines included in the second line; and a base material joining step of joining a base material start edge of the flexible base material whose route is changed in the route changing step to any one of the flexible base materials held in the conveyance preparing step.

10. A base material processing method for performing line connection through processing to-be-processed continuous flexible base materials between a first line comprised of a plurality of lines and a second line comprised of a single of line, comprising:

a plurality of base material conveying steps of receiving and conveying to-be-processed flexible base materials from the corresponding lines of the first line;

a base material dividing step of dividing the flexible base materials conveyed from the plurality of lines of the first line in the base material conveying steps;

a route changing step of receiving a flexible base material from its base material start edge formed by division in the base material dividing step, and changing a conveyance route for the received flexible base material;

a conveyance preparing step of holding for conveying to the second line a flexible base material before the second line; and a first base material joining step of joining a base material start edge of the flexible base material whose route is changed in the route changing step to a base material end edge of the flexible base material held in the conveyance preparing step.

* * * * *